US005658184A

United States Patent [19]

Hoopman et al.

[11] Patent Number: 5,658,184

[45] Date of Patent: Aug. 19, 1997

[54] NAIL TOOL AND METHOD OF USING SAME TO FILE, POLISH AND/OR BUFF A FINGERNAIL OR A TOENAIL

[75] Inventors: Timothy L. Hoopman, River Falls, Wis.; Scott R. Culler, Burnsville, Minn.

[73] Assignee: Minnesota Mining and Manufacturing Company, St. Paul, Minn.

[21] Appl. No.: 567,712

[22] Filed: Dec. 5, 1995

Related U.S. Application Data

[63] Continuation of Ser. No. 303,497, Sep. 9, 1994, abandoned, which is a continuation-in-part of Ser. No. 120,300, Sep. 13, 1993, abandoned.

[51] Int. Cl.[6] ..... B24B 7/19

[52] U.S. Cl. ..... 451/28; 451/527; 451/530; 451/539

[58] Field of Search ..... 451/28, 526, 527, 451/528, 530, 538, 539, 540, 552; 51/295

[56] References Cited

U.S. PATENT DOCUMENTS

| | | | |
|---|---|---|---|
| Re. 29,808 | 10/1978 | Wagner | 51/401 |
| 1,941,962 | 1/1934 | Tone | 91/67.9 |
| 1,988,065 | 1/1935 | Wooddell | 91/68 |
| 2,001,911 | 5/1935 | Wooddell et al. | 51/190 |
| 2,015,658 | 10/1935 | Bezzenberger | 51/278 |
| 2,094,824 | 10/1937 | Sanford | 280/95 |
| 2,108,645 | 2/1938 | Bryant | 91/68 |
| 2,115,897 | 5/1938 | Wooddell et al. | 51/188 |
| 2,242,877 | 5/1941 | Albertson | 51/293 |
| 2,252,683 | 8/1941 | Albertson | 51/293 |
| 2,755,607 | 7/1956 | Haywood | 51/185 |
| 2,806,772 | 9/1957 | Robie | 51/296 |
| 2,876,086 | 3/1959 | Raymond | 51/298 |
| 2,907,146 | 10/1959 | Dyar | 51/195 |
| 3,048,482 | 8/1962 | Hurst | 51/298 |

(List continued on next page.)

FOREIGN PATENT DOCUMENTS

| | | |
|---|---|---|
| 2009718 | 8/1990 | Canada . |
| 004454 A3 | 10/1979 | European Pat. Off. . |
| 109851 A2 | 5/1984 | European Pat. Off. . |
| 168065 A1 | 1/1986 | European Pat. Off. . |
| 306161 A2 | 11/1988 | European Pat. Off. . |
| 306162 A2 | 11/1988 | European Pat. Off. . |
| 345239 A1 | 12/1989 | European Pat. Off. . |
| 429269A1 | 5/1991 | European Pat. Off. . |
| 554668A1 | 8/1993 | European Pat. Off. . |
| 650803 A1 | 5/1995 | European Pat. Off. . |
| 650807 A1 | 5/1995 | European Pat. Off. . |
| 881239 | 4/1943 | France . |
| 2354373 | 1/1978 | France . |

(List continued on next page.)

OTHER PUBLICATIONS

Michael J. Merchant; *FORTRAN* 77; Wadsworth Publishing Co.; Belmont, CA; 1981; pp. 252–254.

"Lenox Hackmaster V Vari-Tooth Power Hack Saw Blades", an advertisement by Lenox Co., undated.

Jaina Wendtland, "Cant't Choose One File?" *Nails*, Jul. 1994, pp. 35, 38, 40, 42, and 43.

(List continued on next page.)

*Primary Examiner*—Eileen P. Morgan

*Attorney, Agent, or Firm*—Gary L. Griswold; Walter N. Kirn; Paul W. Busse

[57] ABSTRACT

A nail tool comprising a substrate having a major surface and an abrasive article attached onto the major surface of the substrate, where the abrasive article is provided having a sheet-like structure having a major surface having deployed in fixed position thereon a plurality of abrasive three-dimensional abrasive composites, each of the composites comprising abrasive particles dispersed in a binder and having a precise shape defined by a distinct and discernible boundary that includes specific dimensions, wherein the precise shapes are not all identical. The invention also relates to a method for using such a nail tool to abrade the surface of a fingernail or toenail.

20 Claims, 5 Drawing Sheets

U.S. PATENT DOCUMENTS

| | | | |
|---|---|---|---|
| 3,057,256 | 10/1962 | Erban | 88/28.93 |
| 3,211,634 | 10/1965 | Lorenzo | 204/16 |
| 3,517,466 | 6/1970 | Bouvier | 51/358 |
| 3,549,341 | 12/1970 | Kittredge et al. | 51/293 |
| 3,594,865 | 7/1971 | Erb | 18/5 |
| 3,605,349 | 9/1971 | Anthon | 51/402 |
| 3,615,302 | 10/1971 | Rowse et al. | 51/295 |
| 3,631,638 | 1/1972 | Yoshikawa | 51/295 |
| 3,641,719 | 2/1972 | Yang | 51/402 |
| 3,661,544 | 5/1972 | Whitaker | 51/925 |
| 3,689,346 | 9/1972 | Rowland | 186/245 |
| 3,712,706 | 1/1973 | Stamm | 350/103 |
| 3,833,703 | 9/1974 | Joos | 264/167 |
| 3,859,407 | 1/1975 | Blanding et al. | 264/62 |
| 3,991,527 | 11/1976 | Maran | 51/397 |
| 4,011,358 | 3/1977 | Roelofs | 428/287 |
| 4,038,047 | 7/1977 | Haywood | 51/295 |
| 4,055,029 | 10/1977 | Kalbow | 51/395 |
| 4,106,915 | 8/1978 | Kagawa et al. | 51/296 |
| 4,311,489 | 1/1982 | Kressner | 51/298 |
| 4,314,827 | 2/1982 | Leitheiser et al. | 51/298 |
| 4,318,766 | 3/1982 | Smith | 156/330 |
| 4,364,746 | 12/1982 | Bitzer et al. | 51/298 |
| 4,420,527 | 12/1983 | Conley | 428/172 |
| 4,456,500 | 6/1984 | Ibeta | 156/634 |
| 4,539,017 | 9/1985 | Augustin | 51/293 |
| 4,553,982 | 11/1985 | Korbel et al. | 51/298 |
| 4,576,850 | 3/1986 | Martens | 428/156 |
| 4,587,291 | 5/1986 | Gardziella et al. | 524/595 |
| 4,588,258 | 5/1986 | Hoopman | 350/103 |
| 4,588,419 | 5/1986 | Caul et al. | 51/295 |
| 4,623,364 | 11/1986 | Cottringer et al. | 51/309 |
| 4,644,703 | 2/1987 | Kaczmarek et al. | 51/401 |
| 4,652,274 | 3/1987 | Boettcher et al. | 51/298 |
| 4,652,275 | 3/1987 | Bloecher et al. | 51/298 |
| 4,735,632 | 4/1988 | Oxman et al. | 51/295 |
| 4,744,802 | 5/1988 | Schwabel | 51/309 |
| 4,751,138 | 6/1988 | Tumey et al. | 428/323 |
| 4,770,671 | 9/1988 | Monroe et al. | 51/293 |
| 4,773,920 | 9/1988 | Chasman et al. | 51/295 |
| 4,775,219 | 10/1988 | Appeldorn et al. | 350/103 |
| 4,799,939 | 1/1989 | Bloecher et al. | 51/293 |
| 4,875,259 | 10/1989 | Appeldorn | 24/576 |
| 4,881,951 | 11/1989 | Wood et al. | 51/309 |
| 4,903,440 | 2/1990 | Larson et al. | 51/298 |
| 4,930,266 | 6/1990 | Calhoun et al. | 51/293 |
| 4,950,696 | 8/1990 | Palazotto et al. | 522/25 |
| 4,952,612 | 8/1990 | Brown-Wensley et al. | 522/25 |
| 4,959,265 | 9/1990 | Wood et al. | 428/343 |
| 4,983,458 | 1/1991 | Dejaiffe | 428/402 |
| 4,985,340 | 1/1991 | Palazzotto et al. | 430/270 |
| 4,997,461 | 3/1991 | Markhoff-Matheny et al. | 51/295 |
| 5,011,508 | 4/1991 | Wald et al. | 51/293 |
| 5,011,513 | 4/1991 | Zador et al. | 51/295 |
| 5,014,468 | 5/1991 | Ravipati et al. | 51/295 |
| 5,015,266 | 5/1991 | Yamamoto | 51/393 |
| 5,022,895 | 6/1991 | Wiand | 51/295 |
| 5,039,311 | 8/1991 | Bloecher | 51/295 |
| 5,061,294 | 10/1991 | Harmer et al. | 51/295 |
| 5,077,870 | 1/1992 | Melbye et al. | 24/452 |
| 5,078,753 | 1/1992 | Broberg et al. | 51/298 |
| 5,086,086 | 2/1992 | Brown-Wensley et al. | 522/25 |
| 5,090,968 | 2/1992 | Pellow | 51/293 |
| 5,093,180 | 3/1992 | Morgan | 428/156 |
| 5,107,626 | 4/1992 | Mucci | 51/281 R |
| 5,107,917 | 4/1992 | Larsson | 160/229.1 |
| 5,131,926 | 7/1992 | Rostoker et al. | 51/309 |
| 5,137,542 | 8/1992 | Buchanan et al. | 51/295 |
| 5,147,900 | 9/1992 | Palazzotto et al. | 522/25 |
| 5,152,917 | 10/1992 | Pieper et al. | 51/295 |
| 5,174,795 | 12/1992 | Wiand | 51/295 |
| 5,176,155 | 1/1993 | Rudolph, Jr. | 451/540 |
| 5,178,646 | 1/1993 | Barber, Jr. et al. | 51/298 |
| 5,199,227 | 4/1993 | Ohishi | 451/527 |
| 5,201,101 | 4/1993 | Rouser et al. | 24/575 |
| 5,201,916 | 4/1993 | Berg et al. | 51/293 |
| 5,203,884 | 4/1993 | Buchanan et al. | 51/295 |
| 5,219,462 | 6/1993 | Bruxvoort et al. | 51/293 |
| 5,236,472 | 8/1993 | Kirk et al. | 51/298 |
| 5,273,805 | 12/1993 | Calhoun et al. | 428/156 |
| 5,275,181 | 1/1994 | Rudolph, Jr. | 132/76.4 |
| 5,287,863 | 2/1994 | La Joie et al. | 132/76.4 |
| 5,304,223 | 4/1994 | Pieper et al. | 51/293 |
| 5,316,812 | 5/1994 | Stout et al. | 428/64 |
| 5,318,604 | 6/1994 | Gorsuch et al. | 51/293 |
| 5,368,619 | 11/1994 | Culler | 51/308 |
| 5,378,251 | 1/1995 | Culler et al. | 51/295 |
| 5,398,455 | 3/1995 | Slavin et al. | 451/552 |
| 5,435,816 | 7/1995 | Spurgeon et al. | 51/295 |
| 5,437,754 | 8/1995 | Calhoun | 156/231 |
| 5,453,312 | 9/1995 | Haas et al. | 428/143 |
| 5,454,844 | 10/1995 | Hibbard et al. | 51/295 |
| 5,489,235 | 2/1996 | Gagliardi et al. | 451/527 |

FOREIGN PATENT DOCUMENTS

| | | | |
|---|---|---|---|
| 57-121458 | 7/1982 | Japan . | |
| 58-196974 | 11/1983 | Japan . | |
| 60-9663 | 1/1985 | Japan . | |
| 61-244468 | 10/1986 | Japan . | |
| 62-255069 | 11/1987 | Japan . | |
| 63-235942 | 9/1988 | Japan . | |
| H2-83172 | 3/1990 | Japan . | |
| 2-83172 | 3/1990 | Japan | B24D 11/00 |
| 4-159084 | 6/1992 | Japan . | |
| 6-190737 | 7/1994 | Japan . | |
| 749650 | 7/1980 | U.S.S.R. . | |
| 975375 | 11/1982 | U.S.S.R. . | |
| 996178 | 2/1983 | U.S.S.R. . | |
| 1316805 | 6/1987 | U.S.S.R. . | |
| 1005448 | 9/1965 | United Kingdom . | |
| 2043501 A | 10/1980 | United Kingdom . | |
| 2094824 | 9/1982 | United Kingdom | B24D 3/28 |
| 92/13680 | 8/1992 | WIPO | B24D 3/28 |
| WO 92/15626 | 9/1992 | WIPO . | |
| WO 93/12911 | 7/1993 | WIPO . | |
| WO 93/13912 | 7/1993 | WIPO . | |
| WO 94/20264 | 9/1994 | WIPO . | |
| WO 94/27780 | 12/1994 | WIPO . | |

OTHER PUBLICATIONS

"Irgacure® 369" Brochure of Ciba–Geigy Corp., 1993.

*Encyclopedia of Polymer Science and Technology*, vol. 8; John Wiley: New York; pp. 661–665 (1968).

J.V. Crivello, "Photoinitiated Cationic Polymerization", *Ann. Rev. mater. Sci.*, 13, 173–190 (1983).

K.L. Wilke et al., "Coated Abrasive Superfinishing: Predictable, Repeatable Texturing of Metal Roll Surfaces", from 3M Industrial Abrasives Division, Doc. No. A–ARLSF(92.05)BPH, May 1992 (8 pages).

"Gem Centerless Microfinishers", Brochure of Grinding Equipment & Machinery Co., Inc., Youngstown, OH (published before Jan. 1, 1990).

"Superfinishing: The Microfinishing Systems Way", Brochure of 3M Microfinishing Systems, 6 pgs (Jul. 14, 1988.

*Kirk–Othmer Encyclopedia of Chemical Technology, Third Edition*, vol. 1; John Wiley: New York; pp. 35–37 (1978).

V.A. Morozov, "How the Surface Relief fo abrasive Belts Affects Efficiency in Grinding Jobs", *Soviet Engineering Research*, 9, 4 103–107 (1989).

NAIL TOOL AND METHOD OF USING SAME TO FILE, POLISH AND/OR BUFF A FINGERNAIL OR A TOENAIL

This is a continuation of application No. 08/303,497 filed Sep. 9, 1994 now abandoned which is a Continuation-In-Part of application No. 08/120,300 filed Sep. 13, 1993 now abandoned.

BACKGROUND OF THE INVENTION

1. Field of the Invention

This invention relates to a novel abrasive article method for filing, polishing, and/or buffing a natural or artificial fingernail or toenail.

2. Discussion of the Art

It is commonplace to enhance the appearance of fingernails and toenails of humans or even animals, such as pets, by filing, polishing and/or buffing these surfaces.

To accomplish this purpose, rigid nail tools, such as emery boards, or flexible nail tools, such as emery sheets, are well known. Other types of nail tools also known include metal nail files. U.S. Pat. No. 5,275,181 (Rudolph, Jr.) describes a method and device for filing nails comprising rubbing the nail with a filing device that captures the dust produced by filing. The device described by the Rudolph, Jr. patent includes a support member, either a board-like member or foam block having a generally flat, planar support surface, and an abrasive member bonded to the planar support surface of the foam strip. The abrasive member comprises a criss-crossed arrangement of spaced-apart thread-like filaments (e.g., essentially a screen cloth) having gritty abrasive material embedded thereon. Additionally, U.S. Pat. No. 5,287,863 (La Joie et al.) describes a nail/file buffer which has a core with at least two layers of resilient material on each side of the core and has at least one abrasive surface. The La Joie et al. patent indicates that the materials suitable to be used as the abrasive surfaces include those abrasive surfaces for abrading natural and artificial fingernails and toenails which are well known in the art.

Certain problems and needs have been found to arise in the milieu of abrading (filing, polishing and/or buffing) of nails in particular, such as the need to provide an ultrafine smooth finish on the nail workpiece, avoiding the inadvertent grabbing of the nail by the nail tool, and providing a nail tool which can be periodically cleaned and sanitized with cleansing liquids without suffering degradation. The nail care field is always looking for new products or methods to solve the above-mentioned problems.

Other general related art includes U.S. Pat. No. 2,115,897 (Wooddell et al.), which teaches an abrasive article having a backing and attached thereto by an adhesive are a plurality of blocks of bonded abrasive material. These bonded abrasive blocks can be adhesively secured to the backing in a specified pattern.

U.S. Pat. No. 2,242,877 (Albertson) teaches a method of making a compressed abrasive disc. The method involves embedding abrasive particles in a binder layer that is coated on a fibrous backing. Then, a mold die is used to impart a molded pattern or contour into the thickness of binder and particle layer under heat and pressure to form a compressed abrasive disc. The molded surface of the abrasive disc has a specified working surface pattern which is the inverse of the profile of the molding die.

U.S. Pat. No. 2,755,607 (Haywood) teaches a coated abrasive in which there are land and groove abrasive portions, which can form, for example, an overall rectilinear or serpentine pattern. An adhesive coat is applied to the front surface of a backing and this adhesive coat is then combed to create peaks and valleys to pattern the surface of the adhesive coat. Haywood discloses that each of the lands and grooves formed in the adhesive coat by such a combing procedure preferably have the same width and thickness, but that they may be varied. Next the abrasive grains are distributed uniformly in the lands and grooves of the previously patterned adhesive coat followed by solidification of the adhesive coat. The abrasive particles used in Haywood are individual grains which are not used in slurry form with other grains in a binder. Therefore, the individual abrasive grains have irregular non-precise shapes.

U.S. Pat. No. 3,048,482 (Hurst) discloses an abrasive article comprising a backing, a bond system and abrasive granules that are secured to the backing by the bond system. The abrasive granules are a composite of abrasive grains and a binder which is separate from the bond system. The abrasive granules are three dimensional and are preferably pyramidal in shape. To make this abrasive article, the abrasive granules are first made via a molding process. Next, a backing is placed in a mold, followed by the bond system and the abrasive granules. The mold has patternized cavities therein which results in the abrasive granules having a specified pattern on the backing.

U.S. Pat. No. 3,605,349 (Anthon) pertains to a lapping type abrasive article. The binder and the abrasive grain are mixed together and then sprayed onto the backing through a grid. The presence of the grid results in a patterned abrasive coating.

Great Britain Patent Application No. 2,094,824 (Moore) pertains to a patterned lapping film. The abrasive slurry is prepared and the slurry is applied through a mask to form discrete islands. Next, the resin or binder is cured. The mask can be a silk screen, stencil, wire, or a mesh.

U.S. Pat. No. 4,644,703 (Kaczmarek et al.) concerns a lapping abrasive article comprising a backing and an abrasive coating adhered to the backing. The abrasive coating further comprises a suspension of lapping size abrasive grains and a binder cured by free radical polymerization. The abrasive coating can be shaped into a pattern by a rotogravure roll.

U.S. Pat. No. 4,773,920 (Chasman et al.) concerns a lapping abrasive article comprising a backing and an abrasive coating adhered to the backing. The abrasive coating comprises a suspension of lapping size abrasive grains and a binder cured by free radical polymerization. The abrasive coating can be shaped into a pattern by a rotogravure roll.

U.S. Pat. No. 4,930,266 (Calhoun et al.) teaches a patterned abrasive sheeting in which the abrasive granules are strongly bonded and lie substantially in a plane at a predetermined lateral spacing. In this invention the abrasive granules are applied via an impingement technique so that each granule is essentially individually applied to the abrasive backing. This results in an abrasive sheeting having a precisely controlled spacing of the abrasive granules.

U.S. Pat. No. 5,014,468 (Ravipati et al.) pertains to a lapping film intended for ophthalmic applications. The lapping film comprises a patterned surface coating of abrasive grains dispersed in a radiation cured adhesive binder. The patterned surface coating has a plurality of discrete raised three-dimensional formations having widths which diminish in the direction away from the backing. To make the patterned surface, an abrasive slurry is applied to a rotogravure roll to provide a shaped surface which is then removed from the roll surface and then the radiation curable resin is cured.

U.S. Pat. No. 5,015,266 (Yamamoto) pertains to an abrasive sheet by uniformly coating an abrasive adhesive slurry over an embossed sheet. The resulting abrasive coating has high and low abrasive portions formed by the surface tension of the slurry, corresponding to the irregularities of the base sheet.

U.S. Pat. No. 5,107,626 (Mucci) teaches a method of providing a patterned surface on a substrate by abrading with a coated abrasive containing a plurality of precisely shaped abrasive composites. The abrasive composites are in a non-random array and the abrasive composites comprise a plurality of abrasive grains dispersed in a binder.

U.S. Pat. No. 5,152,917 (Pieper et al.) discloses a coated abrasive article that provides both a relatively high rate of cut and a relatively fine surface finish on the workpiece surface. The structured abrasive of Pieper et al. involves precisely shaped abrasive composites that are bonded to a backing in a regular nonrandom pattern. The consistency of the profile of the abrasive composites provided by the abrasive structure of Pieper et al., among other things, helps provide a consistent surface finish in the worked surface.

Japanese Patent Application No. JP 63-235942 published Mar. 23, 1990 teaches a method of making a lapping film having a specified pattern. An abrasive slurry is coated into a network of indentations in a tool. A backing is then applied over the tool and the binder in the abrasive slurry is cured. Next, the resulting coated abrasive is removed from the tool. The binder can be cured by radiation energy or thermal energy.

Japanese Patent Application No. JP 4-159084 published Jun. 2, 1992 teaches a method of making a lapping tape. An abrasive slurry comprising abrasive grains and an electron beam curable resin is applied to the surface of an intaglio roll or indentation plate having a network of indentations. Then, the abrasive slurry is exposed to an electron beam which cures the binder and the resulting lapping tape is removed from the roll.

U.S. patent application No. 07/820,155 filed 13 Jan. 1992 (Calhoun), RELATED TO PUBLICATION EP #554,668, PUBLISHED Aug. 11, 1993, which is commonly assigned to the owner of the present application, teaches a method of making an abrasive article. An abrasive slurry is coated into recesses of an embossed substrate. The resulting construction is laminated to a backing and the binder in the abrasive slurry is cured. The embossed substrate is removed and the abrasive slurry adheres to the backing.

U.S. Pat. No. 5,219,462 (Bruxvoort et al.) teaches a method for making an abrasive article. An abrasive slurry is coated substantially only into the recesses of an embossed backing. The abrasive slurry comprises a binder, abrasive grains and an expanding agent. After coating, the binder is cured and the expanding agent is activated. This causes the slurry to expand above the surface of the embossed backing.

U.S. patent application No. 08/004,929 filed 14 Jan. 1993 (Spurgeon et al.), which is commonly assigned to the owner of the present application, teaches a method of making an abrasive article. In one aspect of this patent application, an abrasive slurry is coated into recesses of an embossed substrate. Radiation energy is transmitted through the embossed substrate and into the abrasive slurry to cure the binder.

U.S. patent application No. 08/067,708 filed 26 May 1993 (Mucci et al.), which is commonly assigned to the owner of the present application, teaches a method of polishing a workpiece with a structured abrasive. The structured abrasive comprises a plurality of precisely shaped abrasive composites bonded to a backing. During polishing, the structured abrasive oscillates.

The use of variable pitch sawing teeth has been disclosed as a cutting edge for a hack saw blade, such as mentioned in a trade advertisement distributed by Lenox Co. and entitled "Lenox Hackmaster V Vari-Tooth Power Hack Saw Blades", to provide balanced cutting action and quiet performance. This hack saw blade design is described as useful to saw metal bar stock, ganged workpieces, or work with holes, slots or interruptions. This hack saw blade design is not specifically disclosed as adaptable for frictional abrasion applications between two rubbing surfaces including a complex three-dimensional working surface, nor does the LENOX publication disclose the wherewithal therefor.

SUMMARY OF THE INVENTION

The present invention provides a nail tool having an abrasive article element which provides a high cut rate yet imparts a relatively fine smooth surface finish on a nail or nail surface. In addition, it can be periodically cleaned and sanitized with liquids without adverse effect thereon. In somewhat more detail, the invention provides a nail tool including an abrasive article as a working (abrading) surface, the abrasive article having a sheet-like structure having a major surface having deployed thereon a plurality of precisely shaped abrasive composites, wherein not all the composite shapes are identical. The invention also provides a method of using such a nail tool to file, polish, and/or buff a nail or nail surface.

For purposes of this invention, the term "nails" includes natural fingernails or toenails of humans or animals as well as artificial nails, such as synthetic polymeric nail materials, adapted to be worn by humans. In one embodiment, this invention relates to a nail tool comprising a substrate having a major surface and an abrasive article attached onto the major surface of the substrate, said abrasive article having a sheet-like structure having a major surface having deployed in fixed position thereon a plurality of three-dimensional abrasive composites, each of the composites comprising abrasive particles dispersed in a binder and having a substantially precise shape defined by a substantially distinct and discernible boundary which includes substantially specific dimensions, wherein the precise shapes are not all identical.

The aforesaid abrasive article is usually attached to a surface of the substrate by an adhesive means. Preferably, the adhesive attachment means is water-insoluble in its cured or solidified state. The adhesive can be thermosetting or thermoplastic, and be applied in liquid or paste form and cured; or it can be a thin solid sheet of thermoplastic hot-meltable material; or it can be a self-supporting compressible integral foam layer or tape having tacky surfaces. This foam layer can be a closed cell or open cell foam such as polyethylene or polyurethane foam. In one preferred embodiment, the adhesive means is a double-sided foam layer having a pressure-sensitive adhesive thereon, which is interposed between the abrasive article and the surface of the substrate to join the two elements together.

In one further embodiment of the nail tool of this invention, the substrate is a rigid member, such as polystyrene, plastic, or wood, with a shape having a relatively small thickness and relatively large surface areas to provide substantially a two-dimensional object with opposing major surfaces. Since the abrasive article can be attached to one or both major surfaces of the rigid substrate, the attachment means is employed as needed in this regard.

In an alternate further embodiment of the nail tool of this invention, the substrate is not a rigid material, but instead is a flexible compressible material such as an open or closed cell polyurethane foam. In this embodiment, the overall shape of the substrate is more three-dimensional, such as an elongate rectangular shape, with a substantial thickness dimension.

In another embodiment of this invention, the aforesaid abrasive composites include a first abrasive composite having a first precise shape having specific first dimensions and a second abrasive composite having a second precise shape and second specific dimensions wherein the first and the second specific dimensions are nonidentical.

In an even further embodiment of the invention, the aforesaid first and second abrasive composites each has a boundary defined by at least four planar surfaces wherein adjacent planar surfaces meet to define an edge of a certain length, wherein at least one edge of the first composite has a length which is different from the length of all edges of the second composite. In one further embodiment, the length of the at least one edge of the first composite has a length which varies with respect to the length of any edge of the second composite in a ratio between 10:1 to 1:10.

In another embodiment of the abrasive article used in the nail tool of the invention, the aforesaid first and second abrasive composites have a first and second geometrical shape, respectively, which are nonidentical. For example, the aforesaid first and second geometrical shapes can be selected from different members of the group of geometrical shapes consisting of cubic, prismatic, conical, truncated conical, cylindrical, pyramidal, and truncated pyramidal.

In yet another embodiment of the abrasive article of the nail tool of the invention, each abrasive composite has a boundary defined by at least four planar surfaces (including the base) wherein adjacent planar surfaces meet at an edge to define an angle of intersection therebetween, wherein at least one angle of intersection of the first abrasive composite is different from all of the angles of intersection of the second composite. In a preferred embodiment, no angle of intersection of adjacent planar surfaces in the first abrasive composite is equal to 0° or 90°. In a further embodiment thereof, substantially all the abrasive composites have a pyramidal shape.

In one preferred embodiment of the invention, the surface of the aforesaid abrasive article has a major length and opposite side edges, each side edge being parallel to the machine direction axis and each side edge being respectively within a first and second imaginary plane each of which is perpendicular to the surface, a plurality of parallel elongate abrasive ridges deployed in fixed position on the surface, each ridge having a longitudinal axis located at its transverse center and extending along an imaginary line which intersects the first and second planes at an angle which is neither 0° nor 90°, and wherein each abrasive ridge comprises a plurality of the aforesaid three-dimensional abrasive composites which are intermittently spaced along the longitudinal axis.

In yet another embodiment of the abrasive article of the nail tool of the present invention, each abrasive ridge has a distal end spaced from the surface and each distal end extends to a third imaginary plane which is spaced from and parallel to the surface. For example, in one embodiment, the abrasive composites have the same height value measured from the surface to distal end in a range of from about 50 micrometers and about 1020 micrometers.

In another preferred embodiment of the abrasive article of the nail tool of this invention, abrasive composites are fixed on the major surface in a density of about 100 to about 10,000 abrasive composites/cm$^2$. In one further embodiment, substantially the entire surface area of the major surface is covered by the abrasive composites.

In still another embodiment, the nail tool described herein is used in a method to abrade the surface of a nail by filing, polishing and/or buffing, having the steps of:

(a) attaching the above-described abrasive article to at least one surface of a substrate to provide the nail tool;

(b) bringing into frictional contact a nail surface and the above-described abrasive article; and (c) moving at least one of said nail tool or said nail surface relative to the other such that either a portion of the nail surface is removed and/or the surface finish of the nail surface is refined.

Other features, advantages, and constructs of the invention will be better understood from the following description of figures and the preferred embodiments of the present invention.

DETAILED DESCRIPTION OF THE PREFERRED EMBODIMENTS

Figure 1:
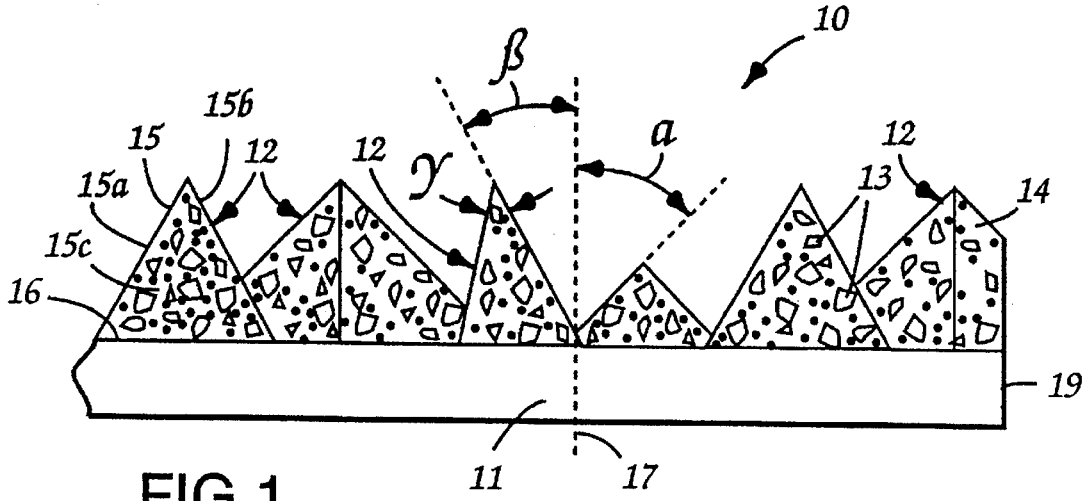
FIG. 1 is an end sectional view representing one embodiment of an abrasive article used in the nail tool of this invention.

It has been discovered that the abrasive article of this invention, described herein, works extremely well in a nail tool for the filing, polishing, and/or buffing of nails. The term "nails" includes natural fingernails or toenails of humans or animals as well as artificial nails adapted to be worn by humans.

The abrasive article used in the nail tool of the invention exhibits a high rate of cut while imparting a relatively level, fine surface finish on the workpiece being abraded and does not readily scribe the nail surface. While not desiring to be bound to any theory at this time, it is hypothesized that an array of abrasive composites having perfect pitch, i.e., an array of abrasive composites that are all identical in dimensions, may generate a vibrational resonance, whereby the working abrasive article surface may reach a resonant vibration state which can cause surface finish problems, or vibrate the operator's or user's hand and/or toes. In the present invention, it is believed that the variation in the dimensions between adjacent precisely-shaped abrasive composites disrupts and/or prevents such vibrational resonance from developing to thus provide a high cut-rate, fine finish with decreased chatter incidence in addition to decreased scribing.

For purposes of this invention, the expression "precisely-shaped", or the like, as used herein in describing the abrasive composites, refers to abrasive composites having a shape that has been formed by curing the curable binder of a flowable mixture of abrasive particles and curable binder while the mixture is both being borne on a backing and filling a cavity on the surface of a production tool. Such a "precisely shaped" abrasive composite would thus have precisely the same shape as that of the cavity. Further, the precise shape of the abrasive composite is defined by relatively smooth-surfaced sides that are bounded and joined by well-defined sharp edges having distinct edge lengths with distinct endpoints defined by the intersections of the various sides with the proviso that at least one of said abrasive composites has at least one dimension which is different from that of an adjacent abrasive composite or composites.

For purposes of this invention, the term "boundary", as used herein to define the abrasive composites, means the exposed surfaces and edges of each abrasive composite that delimit and define the actual three-dimensional shape of each abrasive composite. These distinct and discernible boundaries are readily visible and clear when a cross-section of the abrasive article is examined under a microscope such as a scanning electron microscope. The distinct and discernible boundaries of each abrasive composite form the cross-sectional outlines and contours of the precise shapes of the present invention. These boundaries separate and distinguish one abrasive composite from another even when the abrasive composites abut each other along a common border at their bases. By comparison, in an abrasive composite that does not have a precise shape, the boundaries and edges are not definitive, e.g., where the abrasive composite sags before completion of its curing.

For purposes of this invention, the term "dimension", as used in connection with defining the abrasive composites, means a measure of spatial extent such as an edge length of a side surface (inclusive of the base) of the shape associated with an abrasive composite or, alternatively, the "dimension" can mean a measure of an angle of inclination of a side surface extending from the backing. Therefore, for purposes of this invention, a "dimension" that is "different" for two different abrasive composites, means an edge length or an angle of intersection made at the meeting edge of two planar surfaces of a shape of a first abrasive composite that is nowhere duplicated in value by any of the edge lengths or angles of intersections defining the shape of a second abrasive composite in the array. These first and second abrasive composites can be adjacent in a preferred embodiment.

For purposes of this invention, the terminology "geometrical shape" means a basic category of three-dimensional regular geometrical shape, such as cubic, pyramidal, prismatic, conical, cylindrical, truncated pyramidal, truncated conical and the like.

For purposes of this invention, the terminology "adjacent composite" or "adjacent composites", or the like, as used herein, means at least two neighboring composites which lack any intervening abrasive composite structure located on a direct line therebetween.

Referring to FIG. 1 for illustrative purposes, the side view of the abrasive article 10 usable in a nail tool of this invention shows a backing 11 having a pair of opposite side edges 19 (one shown), a machine direction axis (not shown) would extend parallel to the direction of said side edges 19 for purposes of this illustration, and a plurality of abrasive composites 12 fixed to at least the top surface 16 of the backing. The abrasive composites 12 comprise a plurality of abrasive particles 13 dispersed in the binder 14. Each abrasive composite has a discernible precise shape. It is preferred that the abrasive particles do not protrude beyond the planar surface planes 15 of the shape before the coated abrasive article is put into service. As the coated abrasive article is being used to abrade a surface, the composite breaks down revealing unused abrasive particles.

In one aspect of the invention, viz., where the abrasive composites are spaced-apart at constant pitch (constant peak-to-peak distance from centers of adjacent abrasive composites), the "adjacent composite" will involve one nearest neighboring composite or multiple nearest neighboring composites equidistantly spaced from the abrasive composite which has the different dimension thereto. However, in another aspect of the invention, if the abrasive composites are spaced at a varied pitch, then it is possible, in that instance, for the "adjacent composite" to involve an abrasive composite which is not necessarily the closest composite as spaced from the abrasive composite having the different dimension thereto, as long as no intervening abrasive structure is located on a direct line therebetween.

Abrasive Article Backing

A backing can be conveniently used in this invention to provide a surface for deploying the abrasive composites thereon, wherein such a backing has a front and back surface and can be any conventional abrasive backing. Examples of such include polymeric film, (including primed polymeric film), cloth, paper, vulcanized fiber, nonwovens, and combinations thereof. The backing optionally may be a reinforced thermoplastic backing, such as described in U.S. Pat. No. 5,316,812 (Stout et al.) or an endless belt as described in the assignee's co-pending U.S. application No. 07/919,541 (Benedict et al., filed 20 Dec. 1991, a related-to publication WO93/12911 published 8 Jul. 1993). The backing may also contain a treatment or treatments to seal the backing and/or modify some physical properties of the backing. These treatments are well known in the art.

The back side of the abrasive article may also contain a slip resistant or frictional coating. An example of such a coating includes compositions containing an inorganic particulate (e.g., calcium carbonate or quartz) dispersed in an adhesive. An antistatic coating comprising materials such as carbon black or vanadium oxide also may be included in the abrasive article, if desired.

Abrasive Composite a. Abrasive Particles

The abrasive particles typically have a particle size ranging from about 0.1 to 1500 micrometers, usually between about 0.1 to 400 micrometers, preferably between 0.1 to 150 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, green silicon carbide, silicon carbide, chromia, alumina zirconia, diamond, iron oxide, ceria, cubic boron nitride, boron carbide, garnet, and combinations thereof.

The term abrasive particles also encompasses when single abrasive particles are bonded together to form an abrasive agglomerate. Suitable abrasive agglomerates for this invention are further described in U.S. Pat. Nos. 4,311,489 (Kressner); 4,652,275 (Bloecher et al.) and 4,799,939 (Bloecher et al.).

It is also within the scope of this invention to have a surface coating on the abrasive particles. The surface coating may have many different functions. In some instances the surface coatings increase adhesion to the binder, alter the abrading characteristics of the abrasive particle, and the like. Examples of surface coatings include coupling agents, halide salts, metal oxides including silica, refractory metal nitrides, refractory metal carbides, and the like.

In the abrasive composite there may also be diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

b. Binder

The abrasive particles are dispersed in an organic binder to form the abrasive composite. The organic binder can be a thermoplastic binder; however, it is preferably a thermosetting binder. The binder is formed from a binder precursor. During the manufacture of the abrasive article, the thermosetting binder precursor is exposed to an energy source which aids in the initiation of the polymerization or curing process. Examples of energy sources include thermal energy and radiation energy which includes electron beam, ultraviolet light, and visible light. After this polymerization process, the binder precursor is converted into a solidified binder. Alternatively for a thermoplastic binder precursor, during the manufacture of the abrasive article the thermoplastic binder precursor is cooled to a degree that results in solidification of the binder precursor. Upon solidification of the binder precursor, the abrasive composite is formed.

The binder in the abrasive composite is generally also responsible for adhering the abrasive composite to the front surface of the backing. However, in some instances there may be an additional adhesive layer between the front surface of the backing and the abrasive composite.

There are two main classes of thermosetting resins, condensation curable and addition polymerized resins. The preferred binder precursors are addition polymerized resins because they are readily cured by exposure to radiation energy. Addition polymerized resins can polymerize through a cationic mechanism or a free radical mechanism. Depending upon the energy source that is utilized and the binder precursor chemistry, a curing agent, initiator, or catalyst is sometimes preferred to help initiate the polymerization.

Examples of typical binders include phenolic resins, urea-formaldehyde resins, melamine formaldehyde resins, acrylated urethanes, acrylated epoxies, ethylenically unsaturated compounds, aminoplast derivatives having pendant alpha, beta- unsaturated carbonyl groups, isocyanurate derivatives having at least one pendant acrylate group, isocyanate derivatives having at least one pendant acrylate group, vinyl ethers, epoxy resins, and mixtures and combinations thereof. The term acrylate encompasses acrylates and methacrylates.

Phenolic resins are widely used in abrasive article binders because of their thermal properties, availability, and cost. There are two types of phenolic resins, resole and novolac. Resole phenolic resins have a molar ratio of formaldehyde to phenol greater than or equal to one to one, typically between 1.5:1.0 to 3.0:1.0. Novolac resins have a molar ratio of formaldehyde to phenol of less than one to one. Examples of commercially available phenolic resins include those known by the tradenames "Durez" and "Varcum" from Occidental Chemicals Corp.; "Resinox" from Monsanto; "Aerofene" from Ashland Chemical Co. and "Aerotap" from Ashland Chemical Co.

Acrylated urethanes are diacrylate esters of hydroxy terminated NCO extended polyesters or polyethers. Examples of commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialities.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl oxyethyl) isocyanurate, 1,3,5-tri(2-methyacryloxyethyl)-s-triazine, acrylamide, methylacrylamide, N-methylacrylamide, N,N-dimethylacrylamide, N-vinylpyrrolidone, and N-vinylpiperidone.

The aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylene-bisacrylamide, ortho and para acrylamidomethylated phenol, acrylamido-methylated phenolic novolac, and combinations thereof. Examples of these materials are further described in U.S. Pat. No. 4,903,440 (Larson et al.) and U.S. Pat. No. 5,236,472 (Kirk et al.).

Isocyanurate derivatives having at least one pendant acrylate group and isocyanate derivatives having at least one pendant acrylate group are further described in U.S. Pat. No.

4,652,274 (Boettcher et al.). One example of such an isocyanurate material is a triacrylate of tris(hydroxy ethyl) isocyanurate.

Epoxy resins have an oxirane and are polymerized by the ring opening. Such epoxide resins include monomeric epoxy resins and oligomeric epoxy resins. Examples of some preferred epoxy resins include 2,2-bis[4-(2,3-epoxypropoxy)-phenyl propane] (diglycidyl ether of bisphenol A) and commercially available materials under the trade designation "Epon 828", "Epon 1004", and "Epon 1001F" available from Shell Chemical Co., "DER-331", "DER-332", and "DER-334" available from Dow Chemical Co. Other suitable epoxy resins include glycidyl ethers of phenol formaldehyde novolac (e.g., "DEN-431" and "DEN-428" available from Dow Chemical Co.).

The epoxy resins of the invention can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other cationic curing agents include a salt having an organometallic complex cation and a halogen containing complex anion of a metal or metalloid which are further described in U.S. Pat. No. 4,751,138 (Tumey et al.) (column 6, line 65 to column 9, line 45). Another example is an organometallic salt and an onium salt is described in U.S. Pat. No. 4,985,340 (Palazzotto) (column 4 line 65 to column 14 line 50); European Patent Applications 306,161 and 306,162. Still other cationic curing agents include an ionic salt of an organometallic complex in which the metal is selected from the elements of Periodic Group IVB, VB, VIB, VIIB and VIIIB which is described in European Patent Application No. 109,851.

Regarding free radical curable resins, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632 (Oxman et al.), entitled Coated Abrasive Binder Containing Ternary Photoinitiator System. The preferred initiator for use with visible light is "Irgacure 369" commercially available from Ciba Geigy Corporation.

The weight ratios between the abrasive particles and binder can range between 5 to 95 parts abrasive particles to 5 to 95 parts binder; more typically, 50 to 90 parts abrasive particles and 10 to 50 parts binder.

c. Additives

The abrasive slurry can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired. The use of these can affect the erodability of the abrasive composite. In some instances an additive is purposely added to make the abrasive composite more erodable, thereby expelling dulled abrasive particles and exposing new abrasive particles.

Examples of useful fillers for this invention include: metal carbonates (such as calcium carbonate {such as chalk, calcite, marl, travertine, marble and limestone}, calcium magnesium carbonate, sodium carbonate, magnesium carbonate), silica {such as quartz, glass beads, glass bubbles and glass fibers} silicates {such as talc, clays, montmorillonite, feldspar, mica, calcium silicate, calcium metasilicate, sodium aluminosilicate, sodium silicate}, metal sulfates {such as calcium sulfate, barium sulfate, sodium sulfate, aluminum sodium sulfate, aluminum sulfate}, gypsum, vermiculite, wood flour, aluminum trihydrate, carbon black, metal oxides {such as calcium oxide or lime, aluminum oxide, titanium oxide}, and metal sulfites {such as calcium sulfite}).

The term filler also encompasses materials that are known in the abrasive industry as grinding aids. A grinding aid is defined as particulate material that the addition of which has a significant effect on the chemical and physical processes of abrading which results in improved performance. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphtalene, pentachloronaphthalene; and polyvinyl chloride. Examples of halide salts include sodium chloride, potassium cryolite, sodium cryolite, ammonium cryolite, potassium tetrafluoroboate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite, and metallic sulfides.

Examples of antistatic agents include graphite, carbon black, vanadium oxide, humectants, and the like. These antistatic agents are disclosed in U.S. Pat. Nos. 5,061,294 (Harmer et al.); 5,137,542 (Buchanan et al.), and 5,203,884 (Buchanan et al.).

A coupling agent can provide an association bridge between the binder precursor and the filler particles or abrasive particles. Examples of coupling agents include silanes, titanates, and zircoaluminates. The abrasive slurry preferably contains anywhere from about 0.01 to 3% by weight coupling agent.

An example of a suspending agent is an amorphous silica particle having a surface area less than 150 meters square/gram that is commercially available from DeGussa Corp., under the trade name "OX-50".

Abrasive Composite Shape

Figure 5:
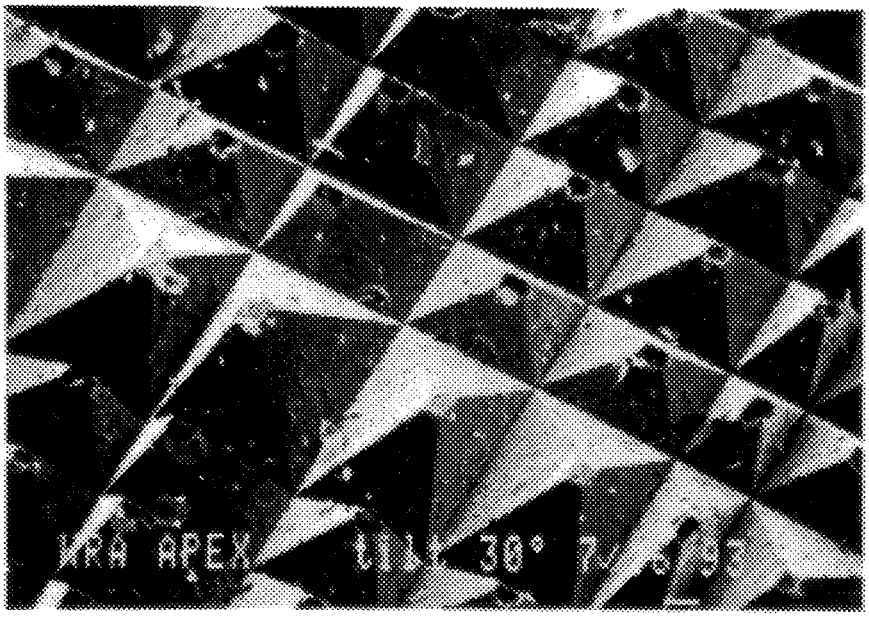
FIG. 5 is a Scanning Electron Microscope (SEM) photomicrograph taken at 45X of the top surface of an having 355 micrometer high pyramidal-shaped abrasive composites of varying dimension.

Each abrasive composite has a precise shape associated with it. The precise shape is delimited by a distinct and discernible boundary, these terms being defined hereinabove. These distinct and discernible boundaries are readily visible and clear when a cross-section of the abrasive article of the invention is examined under a microscope such as a scanning electron microscope, e.g., as shown in FIG. 5. The distinct and discernible boundaries of each abrasive composite form the outline or contour of the precise shapes of the present invention. These boundaries separate and distinguish one abrasive composite from another even when the abrasive composites abut each other along a common border at their bases.

Figure 6:
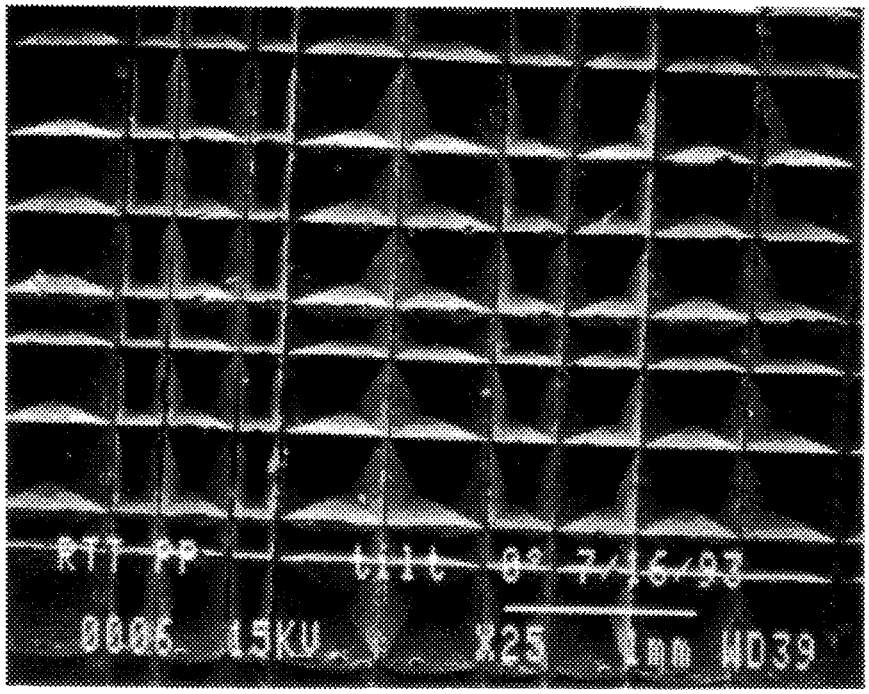
FIG. 6 is a SEM photomicrograph taken at 25X of the top surface of a polypropylene production tool used to make an abrasive article usable in the nail tool of the present invention having about 355 micrometer deep pyramidal-shaped cavities of varying dimensions.

In comparison, in an abrasive composite that does not have a precise shape, the boundaries and edges are not definitive, e.g., where the abrasive composite sags before completion of its curing. Thus, the expression "precisely-shaped", or the like, as used herein in describing the abrasive composites, also refers to abrasive composites having a shape that has been formed by curing the curable binder of a flowable mixture of abrasive particles and curable binder while the mixture is both being borne on a backing and filling a cavity on the surface of a production tool. Such a precisely shaped abrasive composite would thus have precisely the same shape as that of the cavity. These cavities in a production tool are depicted in FIG. 6.

A plurality of such composites provide three-dimensional shapes that project outward from the surface of the backing in an inverse pattern to that presented by the production tool. Each composite is defined by a well-defined boundary or perimeter, the base portion of the boundary being the interface with the backing to which the precisely shaped composite is adhered. The remaining portion of the boundary is defined as the inverse shape of the cavity in the surface of the production tool in which the composite is cured. The entire outer surface of the composite is confined, either by the backing or by the cavity, during its formation. Suitable methods and techniques for forming precisely-shaped composites are disclosed in U.S. Pat. No. 5,152,917 (Pieper et al.) and U.S. Ser. No. 08/004,929 (Spurgeon et al.), filed 14 Jan. 1993.

This invention provides differently dimensioned shapes, among other things, in the array of abrasive composites. This proviso can be established by any convenient approach, e.g., by arbitrarily assigning at least one dimensional variance, such as defined hereinbelow, between adjacent composite shapes in a portion or the whole of the array of composites for an abrasive article. An array of grooves can be formed in a surface of a master tool, e.g., by use of a diamond turning machine, from which is produced a production tool having an array of cavity shapes, which, in turn, can receive and mold an abrasive slurry described herein, which are the inverse shape of the predetermined array of abrasive composite shapes. Alternatively, as described herein, a copy of a desired pattern of variably dimensioned shapes of abrasive composites can be formed in the surface of a so-called metal master, e.g., aluminum, copper, bronze, or a plastic master such as acrylic plastic, either of which can be nickel-plated after grooving, as by diamond turning grooves to leave upraised portions corresponding to the desired predetermined shapes of the abrasive composites. Then, flexible plastic production tooling can be formed, in general, from the master by a method explained in U.S. Pat. No. 5,152,917 (Pieper et al.). As a result, the plastic production tooling has a surface which includes indentations having the inverse shape of the abrasive composites to be formed therewith. Alternatively, the metal master can be manufactured by diamond turning grooves to leave the desired shapes in a metal surface which is amenable to diamond turning, such as aluminum, copper or bronze, and then nickel plating the grooved surface to provide the metal master. Exemplary techniques for making the varying dimensioned abrasive composites will be described in greater detail hereinbelow.

Figure 2:
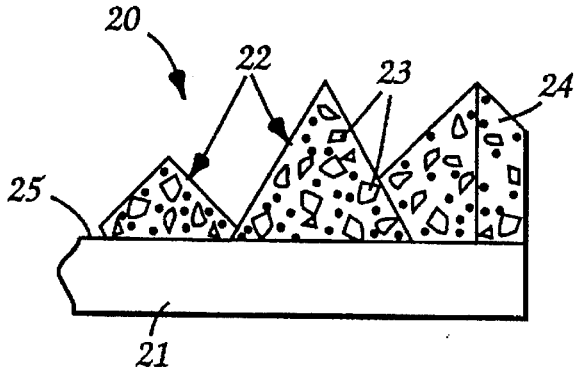
FIG. 2 is an end sectional view representing another embodiment of an abrasive article used in the nail tool of this invention.

Regarding the construction of the abrasive composites per se, referring to FIG. 1 for illustrative purposes, the abrasive composite 12 has a boundary 15. The boundary or boundaries associated with the shape result in one abrasive composite being physically separated to some extent from another adjacent abrasive composite. To form an individual abrasive composite, a portion of the boundaries forming the shape of the abrasive composite must be separated from one another. Note that in FIG. 1, the base or a portion of the abrasive composite closest to the backing can abut with an adjacent abrasive composite. Referring to FIG. 2, the abrasive article 20 of the invention comprises a backing 21 having a plurality of abrasive composites 22 bonded to the backing. The abrasive composites comprise a plurality of abrasive particles 23 that are dispersed in a binder 24. In this aspect of the invention, there are open spaces 25 between adjacent composites. It is also within the scope of this invention to have a combination of abrasive composites bonded to a backing in which some of adjacent abrasive composites abut, while other adjacent abrasive composites have open spaces between them.

In some instances, e.g., pyramidal non-cylindrical shapes, the boundaries forming the sides of the shape also are planar. For such shapes that have multiple planes, there are at least four planes (inclusive of three sides and the bottom or base). The number of planes for a given shape can vary depending upon the desired geometry, for instance, the number of planes can range from four to over 20. Generally, there are between four to ten planes, preferably between four to six planes. These planes intersect to form the desired shape and the angles at which these planes intersect will determine the shape dimensions. Referring to FIG. 1, the abrasive composite 12 has a boundary 15 which is planar. The side planes 15A and 15*b* intersect at an angle $\gamma$, with cross-section 15C facing the viewer and is coplanar with the page.

A key aspect of this invention is that at least one of the abrasive composites has a different dimension from another abrasive composite in the array. Preferably, the different dimension is established between at least one pair of adjacent composites, and even more preferably, established for each and every pair of adjacent composites provided on the surface of the abrasive article. The terminology of "every pair" of adjacent composites encompasses an arbitrary consideration of every composite on the surface of the abrasive article as paired with its adjacent composite. In general, at least 10% of the pairs of adjacent composites have a different dimension therebetween, preferably at least 30%, more preferably at least 50%. Most preferably, substantially 100% of the abrasive composites have a different dimension from its respective paired adjacent abrasive composite. The result of this proviso of different dimensions between abrasive composites, viz. between adjacent pairs of abrasive composites, results in an abrasive article that produces a relatively finer surface finish on the workpiece being abraded or refined. Since the dimensions of adjacent abrasive composites vary, there is a reduced tendency for scribed grooves to be imparted by the precisely abrasive composites into the workpiece surface. In general, if less than 10% of the pairs of abrasive composites have an adjacent composite that has a different dimension, the effect of the invention of decreasing scribing while achieving high-cut rates and fine finishes may not be satisfactorily realized. In general, the number of pairs of adjacent abrasive composites that have different dimensions is selected to minimize or reduce scribing. The percentage of the total abrasive composites that this number of pairs represents will depend upon several factors such as the workpiece type, abrading interface pressure, abrasive article rotation speed and other typical abrading conditions.

It is within the scope of this invention to have some, but never all, of the abrasive composites present on the surface which have identical shapes. However, the abrasive composites having identical shapes, if present, preferably should not be located directly adjacent to or next to one another in order to fully realize the benefits of the invention. For instance, two abrasive composites in the abrasive article may have shapes defined by same dimensions, but, preferably, the two abrasive composites should be separated from one another in the array of composites by at least one intervening abrasive composite that differs in a dimension from each.

There must be at least one dimension associated with at least one of the abrasive composites that is different from another abrasive composite. However, it also is within the scope of this invention that there are two or more different dimensions therebetween. These dimensions can be varied in a variety of ways, such as by providing a different length of an edge at the intersection of two planar surfaces of a shape of a composite; by providing a different angle formed at the meeting edge of two adjacent planar surfaces of a shape of a composite; or by providing different types of geometrical shapes for the abrasive composites to provide either a different edge length and/or a different angle.

If an edge length is varied to provide the different dimension for purposes of the invention, in one embodiment, the length or dimensions of the edges in composites, particularly adjacent composites, each having a pyramidal shape as the geometrical shape and a common height of between 25 and 1020 micrometers, generally can differ from at least about 1 to about 500 micrometers, and more preferably between 5 to 250 micrometers. In one embodiment, the length of the at least one edge of a first composite in the array has a length which varies with respect to the length of any edge of a second composite in a ratio between 10:1 to 1:10, and preferably as between two adjacent composites.

More generally, the abrasive composite shape of this invention can be any convenient shape, but it is preferably a three-dimensional regular geometric shape such as a cubic, prismatic (e.g., triangular, quadrilateral, hexagonal, etc.), conical, truncated conical (flat top), cylindrical, pyramidal, truncated pyramidal (flat top), and the like. The geometrical shape of adjacent abrasive composites can be varied, e.g., pyramidal next to prismatic, in order to provide the requisite dimensional variance therebetween. In one embodiment of the invention, the shapes of the abrasive composites, e.g., pyramidal, all are provided with the same total height value, measured from the backing, in a range of from about 50 micrometers to about 1020 micrometers.

A preferred geometrical shape is a pyramid and the pyramid can be a four- or five-sided (inclusive of the base) pyramid. In one preferred embodiment, all composite shapes are pyramidal. Even more preferably, the dimensional variance is achieved between adjacent pyramidal-shaped composites by varying the angle formed by a side surface with the backing in adjacent pyramids. For example, angles $\alpha$ and $\beta$ formed by the sides of adjacent pyramidal shaped composites, such as depicted in FIG. 1, are different angles from each other and each has a value of between 0° and 90° (i.e. non-inclusive of 0° and 90°). Preferably, the angle $\alpha$ or $\beta$ formed between a side surface of the pyramidal-shaped composites and an imaginary plane 17 (FIG. 1) extending normal to the intersection of the respective side surface and the backing should be greater than or equal to 8°, but less than or equal to 45°. From a practical standpoint, angles less than 8° may release cured composite shapes from the production tool with greater difficulty. On the other hand, angles greater than 45° may unduly enlarge the spacing between adjacent abrasive composites such that insufficient abrading surfaces are provided over the area of the backing.

It also is preferable to select angles for $\alpha$ and $\beta$ wherein each have a value between 0° and 90° and which differ in magnitude by at least about 1°, and more preferably at least about 5°.

It is also preferred to form pyramidal shapes for the abrasive composites where two side surfaces of each pyramid meet at the apex of each pyramid to form a material-included angle $\gamma$ (see FIG. 1) in a cross-sectional view of the pyramid having a value of greater than or equal to 25° and less than or equal to 90°. The lower value of 25° may be a practical limit since it can be difficult to form a peak or apex shape for an abrasive composite which is sharp and less than 25° with the slurry and production tool methodology described herein. To more fully realize the benefits of the invention, this proviso with respect to material-included angle $\gamma$ should be used together with the above-mentioned proviso that intervening angles $\alpha$ and $\beta$ between adjacent composites be provided as different and randomly selected between 0° and 90° as explained hereinabove.

Further, in any individual abrasive composite, the angles made by the various surface planes with the backing do not necessarily have to be the same for a given composite. For instance, in a four-sided pyramid (one base and three side surfaces), the angles formed by any of the first, second and third side planes with the backing can be different from each other. Naturally, the angle at which the side surfaces intersect with each other will also vary as the angle formed between the side surface and the backing are varied.

Also, in the embodiment of this invention where the dimensional variance between adjacent composites is established by varying side surface angles between adjacent abrasive composites, such as angles $\alpha$ and $\beta$ (FIG. 1), it is preferred that the respective angles chosen for each of $\alpha$ and $\beta$ between adjacent composites are not repeated and constant throughout the array of abrasive composites, which is believed to even further ensure no resonance is created between the workpiece and the abrasive article. Therefore, it is more desirable to permit and provide different values for each of $\alpha$ and $\beta$ between 0° and 90° as one proceeds from one pair adjacent composites to the next immediate pair of adjacent composites along either the widthwise or lengthwise direction of the abrasive article (e.g., see FIG. 8). This change in the values of $\alpha$ and $\beta$ between different sets of adjacent composites in the array can be effected in any convenient manner, such as by randomly picking the values for each of $\alpha$ and $\beta$ between the range 0 and 90 degrees.

For example, if $\alpha$, as the right half angle (FIG. 1), can be randomly selected in the range of between 0° and 90° for an abrasive composite in one row of composites, then $\beta$, as the left half angle facing $\alpha$, is randomly chosen for the adjacent abrasive composite in the adjacent row of composites; and then, as one precedes to the next pair of adjacent abrasive composites in either the widthwise or lengthwise direction along the rows of composites in the array, a new $\beta$, as left half angle, is randomly selected between 0° and 90° degrees and then a new value for $\alpha$, as the facing right half angle, of the adjacent composite can be randomly selected in the range of 0° to 90° degrees, and so forth throughout the array. This practice is desirable in order to provide a more uniform distribution of angles between 0° and 90° degrees throughout the array of abrasive composites in the article.

The actual selection of the angles $\alpha$ and $\beta$, and $\gamma$, throughout the array of abrasive composites, randomly and subject to the preferred constraints described herein, can be accomplished in any convenient manner, for example, by systematic random selections of angle values by draw within the preferred numerical constraint mentioned herein. These systematic selections for an array, can be facilitated and expedited by using a common computer, e.g., a desktop computer, using the angle constraints described herein to delimit the range of angle values from which the computer makes a random choice. Algorithms for selection of random numbers are generally known in the statistical and computer fields, and have been adapted to this aspect of the invention. For instance, the well-known linear congruential method for generating pseudorandom numbers can be applied towards randomly selecting the angles α and β. The application and implementation of random number generation for selecting angles for the side faces of the abrasive composite shapes in the present application is exemplified in the computer source code described in the APPENDIX hereinafter.

In any event, the angle values, once so selected for the abrasive composites in the array, can be used to determine and predicate the pattern and shapes of indentations formed by a diamond turning machine in the surface of a metal production tool or production tool, which, in turn, can be used to make the abrasive composite articles of the invention by methods described herein.

In some instances it is preferred to have the height and geometrical shape of all the composites the same. This height is the distance of the abrasive composite from the backing to its outermost point before the abrasive article is used. If the height and shape are constant, it is then preferred to have the angle between planes vary.

In order to achieve a fine surface finish on the workpiece, it is also preferred that the peaks of the abrasive composites do not align in a column which is parallel to the abrading direction performed in the machine direction. If the abrasive composite peaks align in a column parallel to the abrading direction, this tends to result in grooves imparted to the workpiece and a coarser surface finish. Thus, it is preferred that the abrasive composites be offset from one another to prevent this alignment.

In general there are at least 5 individual abrasive composites per square centimeter. In some instances, there may be at least about 100 individual abrasive composites/square centimeter or higher, and more preferably, about 2,000 to 10,000 abrasive composites/square centimeter. There is no operational upper limit on the density of the abrasive composites; although, from a practical standpoint, at some point it may not be possible to increase the cavity density and/or form precisely shaped cavities in the surface of the production tooling preferably used to make the array of abrasive composites. In general, this number of abrasive composites results in an abrasive article that has a relatively high rate of cut, a long life, but also results in a relatively fine surface finish on the workpiece being abraded. Additionally, with this number of abrasive composites there is a relatively low unit force per each abrasive composite. In some instances, this can result in better, more consistent, breakdown of the abrasive composite.

Method of Making the Abrasive Article

Although additional details will be described later herein on the methods of making the abrasive article used in the nail tool of the invention, in general, the first step in making the abrasive article is to prepare an abrasive slurry. The abrasive slurry is made by combining together by any suitable mixing technique the binder precursor, the abrasive particles, and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum during the mixing step, for example, by employing conventional vacuum-assisted methods and equipment.

In some instances it is preferred to heat, generally in the range of 30° to 70° C., the abrasive slurry to lower the viscosity. It is important the abrasive slurry have a rheology that coats well and in which the abrasive particles and other fillers do not settle.

If a thermosetting binder precursor is employed, the energy source can be thermal energy or radiation energy depending upon the binder precursor chemistry. If a thermoplastic binder precursor is employed the thermoplastic is cooled such that it becomes solidified and the abrasive composite is formed. Other more detailed aspects of the method(s) to make the abrasive article of the invention will be described hereinbelow.

Production Tool

A production tool is important, from both practical and technological standpoints, in making an abrasive article of the invention, especially in view of the relatively small sizes of the abrasive composites. The production tool contains a plurality of cavities. These cavities are essentially the inverse shape of the abrasive composite desired and are responsible for generating the shape of the abrasive composites. The dimensions of the cavities are selected to provide the desired shape and dimensions of the abrasive composites. If the shape or dimensions of the cavities are not properly fabricated, the resulting production tool will not provide the desired dimensions for the abrasive composites.

The cavities can be present in a dot-like pattern with spaces between adjacent cavities or the cavities can abut against one another. The cavities butt up against one another to facilitate release of the shaped and cured abrasive slurry. Additionally, the shape of the cavities is selected such that the cross-sectional area of the abrasive composite decreases in the direction away from the backing.

In a more preferred embodiment of the production tool, the production tool has two opposing parallel side edges bounding an array of cavities so configured to provide differing dimensions in the shapes of adjacent abrasive composites formed therewith by methods described herein over a distinct segment of length of the abrasive article, in either a length and/or width direction of the abrasive article, and then this predetermined pattern of differing composite shapes can be repeated at least once more or repeatedly along the length and/or width of the abrasive article, if desired and convenient.

Figure 7:
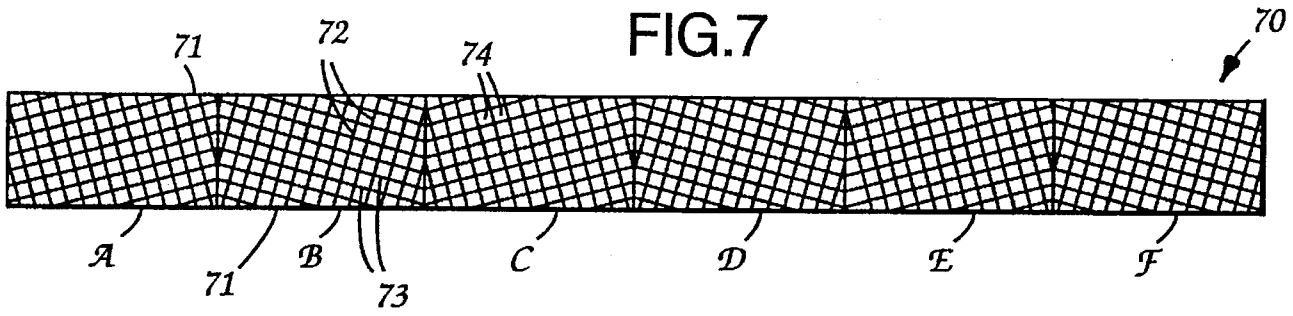
FIG. 7 is a plane view in schematic of a production tool used to make an abrasive article usable in the nail tool of the present invention.

For example, FIG. 7 is a top view representation of a production tool 70 that can be used to make an abrasive article of the invention. The side edges 71 of the production tool are parallel to the machine direction (not shown) of the production tool and are perpendicular to the transverse width direction of the production tool. Cavitites 74 are delimited by intersecting upraised portions represented by solid lines 72 and 73. The production tool has six distinct groups A, B, C, D, E and F of cavities, wherein in each group the cavities are aligned in parallel rows bounded by upraised portions 72, wherein the upraised portions 72 and 73 are the nondeformed (noncavitated) remainder of the tooling sheet. These groups A-E are arranged head-to-tail along the length of the tooling, as shown in FIG. 7. The rows of cavities in each group that are aligned most closely with side edges 71 trace imaginary lines extending at non-parallel (nonzero) angles to the machine direction of the production tool, and which angles differ from group A to group B to group C, and so forth up to group F. The angles of the rows of cavities (and intervening upraised portions 72) made with the side edges 71 should be established as between 0° to 90°. Scribing problems can arise at either 0° or 90° angles for rows of cavities with the side edges 71. Preferably, angles of 5° to 85° are selected for the angles of the rows of cavities with the machine direction more assuredly avoid scribing problems.

The angles of the rows of cavities preferably alternate between clockwise and counterclockwise directionality from group to group, as shown in FIG. 7. The angle formed between rows of cavities and upraised portions 72 and the side edges 71 can be selected to be the same or different in absolute magnitude from set to set.

An abrasive article formed with production tool 70 by methods described herein will have an array of abrasive composites formed in the inverse shape to the surface profile presented by the array of cavities in the production tool, such production tool 70. By arranging rows of cavities at angles in the production tooling by means of arrangements such as exemplified in FIG. 7, scribing effects can be minimized in the abrasive article made thereby.

Alternatively, the cavities in the production tool can be arranged to be laterally offset, i.e., nonaligned, from one another in the direction advancing parallel to the side edges of the production tool (nondepicted). That is, this embodiment provides an optional manner of forming an array of abrasive composites and intervening grooves which are not arranged in rows which extend parallel to the side edges of the abrasive article. Instead, the abrasive composites are staggered from each other and nonaligned when viewed from the front of the abrasive article into the direction parallel to the side edges of the abrasive article.

The production tool can be a belt, a sheet, a continuous sheet or web, a coating roll such as a rotogravure roll, a sleeve mounted on a coating roll, or die. The production tool can be composed of metal, (e.g., nickel), metal alloys (e.g., nickel alloys), plastic (e.g., polypropylene, an acrylic plastic), or any other conveniently formable material. The metal production tool can be fabricated by any conventional technique such as engraving, hobbing, electroforming, diamond turning, and the like.

A thermoplastic production tool can be made by replication off a metal master tool. The metal master will have the inverse pattern desired for the production tool. The metal master can be made with the same basic techniques useful in directly making the production tool, e.g., by diamond turning a metal surface. In the event of use of a metal master, a thermoplastic sheet material can be heated and optionally along with the metal master such that the thermoplastic material is embossed with the surface pattern presented by the metal master by pressing the two surfaces together. The thermoplastic can also be extruded or cast onto to the metal master and then pressed. The thermoplastic material is cooled to solidify and produce the production tool. Examples of preferred thermoplastic production tool materials include polyester, polycarbonates, polyvinyl chloride, polypropylene, polyethylene and combinations thereof.

Alternatively, a plastic production tool can be directly made, without the need of a master by engraving or diamond turning a predetermined array of cavities, which have the inverse shape of the abrasive composites desired, into a surface of the plastic sheet. If a thermoplastic production tool is utilized, then care must be taken not to generate excessive heat, particularly during the solidifying step, that may distort the thermoplastic production tool. Other suitable methods of production tooling and metal masters are discussed in commonly assigned U.S. patent application No. 08/004,929 (Spurgeon et al.), filed 14 Jan. 1993.

For example, a preferred method of making a polymeric production tool of the invention of the type depicted in FIG. 7 involves the use of a nickel-plated metal master configured in a drum form. Several flat sections of nickel-plated master, each about 30 centimeters in length, with the varied shapes of indentations corresponding to the shapes desired for the abrasive composites are provided in a surface thereof, are produced by diamond turning with the aid of a computer directing the cutting action performed by the diamond turning machine. These sections of metal master are welded together head-to-tail, with the grooves of section being at a non-zero angle to the grooves of the next adjacent section. This chain of sections is then fixed to a drum so that the composites are continuous around the circumference of the drum. Care should be taken to minimize any weld seams from distending out from between the sections and at the point of joining. The production tool is cast by extruding polymeric resin onto the drum and passing the extrudant between a nip roll and the drum, and then cooling the extrudant to form a production tool in sheet form having an array of cavities formed on the surface thereof in inverse correspondence to the surface indentations presented by the master on the drum. This process can be conducted continuously to produce a polymeric tool of any desired length.

Energy Sources

When the abrasive slurry comprises a thermosetting binder precursor, the binder precursor is cured or polymerized. This polymerization is generally initiated upon exposure to an energy source. Examples of energy sources include thermal energy and radiation energy. The amount of energy depends upon several factors such as the binder precursor chemistry, the dimensions of the abrasive slurry, the amount and type of abrasive particles and the amount and type of the optional additives. For thermal energy, the temperature can range from about 30° to 150° C., generally between 40° to 120° C. The time can range from about 5 minutes to over 24 hours. The radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. It is preferred that 300 to 600 Watt/inch (120–240 Watt/cm) ultraviolet lights are used. Visible radiation refers to non-particulate radiation having a wavelength within the range of about 400 to about 800 nanometers, preferably in the range of about 400 to about 550 nanometers. It is preferred that 300 to 600 Watt/inch (120–240 Watt/cm) visible lights are used.

Figure 3:
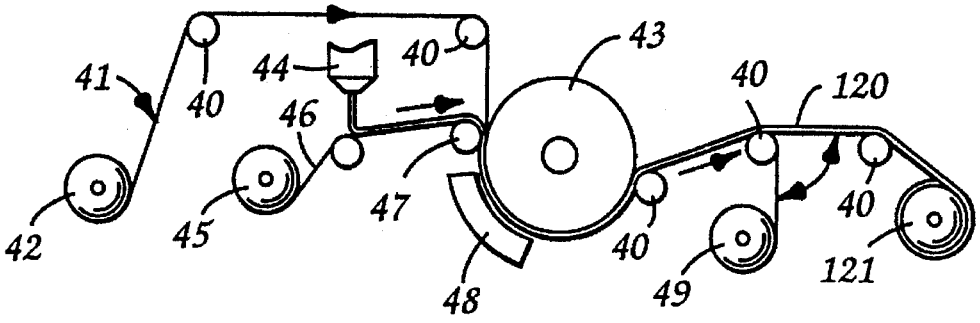
FIG. 3 is a side schematic view showing an apparatus for making an abrasive article used in the nail tool according to this invention.

One method to make the abrasive article used in the nail tool of the invention is illustrated in FIG. 3. Backing 41 leaves an unwind station 42 and at the same time the production tool 46 leaves an unwind station 45. Cavities (not depicted) formed in the upper surface of production tool 46 are coated and filled with an abrasive slurry by means of coating station 44. Alternatively, coating station 44 can be relocated to deposit the slurry on backing 41 instead of the production tool before reaching drum 43 and the same ensuing steps are followed as used for coating the production tooling as described below. Either way, it is possible to heat the abrasive slurry (not shown) and/or subject the slurry to ultrasonics prior to coating to lower the viscosity. The coating station can be any conventional coating means such as drop die coater, knife coater, curtain coater, vacuum die coater or a die coater. After the production tool is coated, the backing and the abrasive slurry are brought into contact by any means such that the abrasive slurry wets the front surface of the backing. In FIG. 3, the abrasive slurry is brought into contact with the backing by means of contact nip roll 47, and contact nip roll 47 forces the resulting construction against support drum 43. Next, any convenient form of energy 48 is transmitted into the abrasive slurry that is adequate to at least partially cure the binder precursor. The term partial cure is meant that the binder precursor is polymerized to such a state that the abrasive slurry does not flow from an inverted test tube. The binder precursor can be fully cured once it is removed from the production tool by any energy source. The production tool is rewound on mandrel 49 so that the production tool can be reused again. Additionally, abrasive article 120 is wound on mandrel 21. If the binder precursor is not fully cured, the binder precursor can then be fully cured by either time and/or exposure to an energy source. Additional steps to make the abrasive article according to this first method is further described in U.S. Pat. No. 5,152,917 (Pieper et al.) or the above-mentioned U.S. patent application No. 08/004,929 (Spurgeon et al.). Other guide rolls are used where convenient and are designated rolls 40.

Relative to this first method, it is preferred that the binder precursor is cured by radiation energy. The radiation energy can be transmitted through the production tool or backing so long as the production tool or backing does not appreciably absorb the radiation energy. Additionally, the radiation energy source should not appreciably degrade the production tool. It is preferred to use a thermoplastic production tool and ultraviolet or visible light.

As mentioned above, in a variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above.

Figure 4:
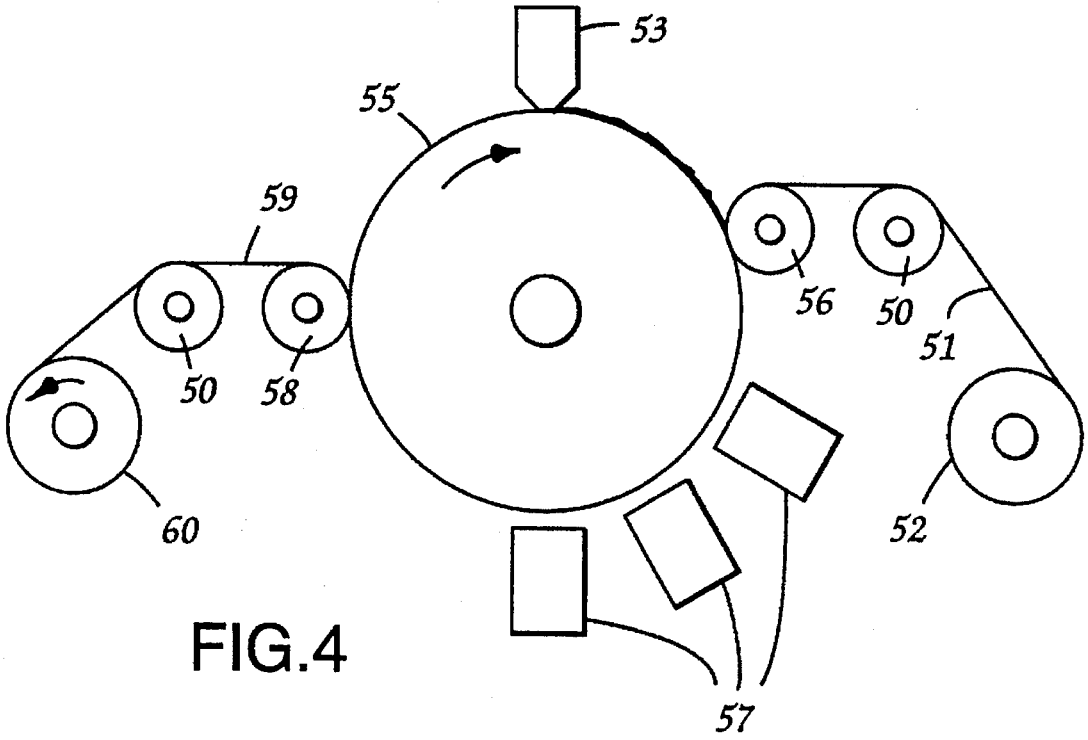
FIG. 4 is a side schematic view showing an alternate apparatus for making an abrasive article used in the nail tool according to this invention.

A second method for making the abrasive article is illustrated in FIG. 4. The production tool 55 is provided in the outer surface of a drum, e.g., as a sleeve which is secured around the circumference of a drum in separate sheet form (e.g., as a heat-shrunk nickel form) in any convenient manner. Backing 51 leaves an unwind station 52 and the abrasive slurry is coated into the cavities of the production tool 55 by means of the coating station 53. The abrasive slurry can be coated onto the backing by any technique such as drop die coater, roll coater, knife coater, curtain coater, vacuum die coater, or a die coater. Again, it is possible to heat the abrasive slurry and/or subject the slurry to ultrasonics prior to coating to lower the viscosity. During coating the formation of air bubbles should be minimized. Then, the backing and the production tool containing the abrasive slurry are brought into contact by a nip roll 56 such that the abrasive slurry wets the front surface of the backing. Next, the binder precursor in the abrasive slurry is at least partially cured by exposure to an energy source 57. After this at least partial cure, the abrasive slurry is converted to an abrasive composite that is bonded or adhered to the backing. The resulting abrasive article 59 is stripped and removed from the production tool at nip rolls 58 and wound onto a rewind station 60. In this method, the energy source can be thermal energy or radiation energy. If the energy source is either ultraviolet light or visible light, the backing should be transparent to ultraviolet or visible light. An example of such a backing is polyester backing. Other guide and contact rolls can be used where convenient and are designated rolls 50.

In another variation of this second method, the abrasive slurry can be coated directly onto the front surface of the backing by moving coating station 53 to a location upstream from roll 56. The abrasive slurry coated backing is then brought into contact with the production tool such that the abrasive slurry wets into the cavities of the production tool. The remaining steps to make the abrasive article are the same as detailed above.

After the abrasive article is made, it can be flexed and/or humidified prior to converting. The abrasive article can be converted into any desired form such as a cone, endless belt, sheet, disc, and the like before the abrasive article is put into service. However, when incorporated into a nail tool, the abrasive article is used in discrete sheet form.

Nail Tool

Figure 9:
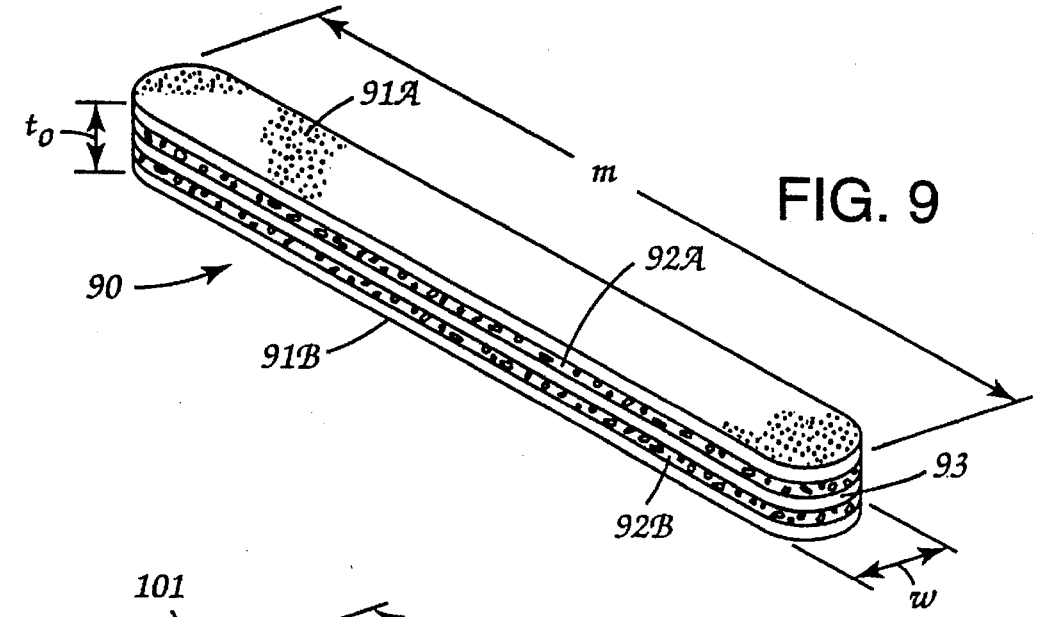
FIG. 9 is a perspective view of a nail tool of the present invention.

For purposes of a preferred embodiment of this invention, the abrasive article described herein is incorporated into a nail tool, such as a nail board. FIG. 9 is a perspective view of one embodiment of a nail board of this invention. In FIG. 9, the thickness aspect of the board has been exaggerated somewhat relative to the major length of the board, as compared to the usual actual dimensions of the board, merely to facilitate the description of the constituent layers appearing in that dimension. The nail board 90 generally comprises a rigid substrate 93, such as plastic,.onto which are disposed adhesive cushion layers 92A and 92B, such as foam, on each face thereof. In FIG. 9, the abrasive articles 91A and 91B, in cut sheet form, are separately bonded to the opposite outer surfaces of rigid substrate 93 via adhesive cushion layers 92A and 92B, respectively, to make the nail board. It is to be understood that it is also within the scope of this invention to have only one abrasive article 91A or 91B attached on one side of the substrate 93. The nail board has major length m, width w and thickness $t_o$. The general dimensions of the board include thicknesses for the overall thickness t of 1–10 mm, a major length m of 10–25 cm, and a width w of the board of 1–4 cm. In one preferred mode, no grooves that are present between the rows of abrasive composites are oriented parallel to the direction of extent of major length "m" so as to further reduce scribing effect.

Figure 11:
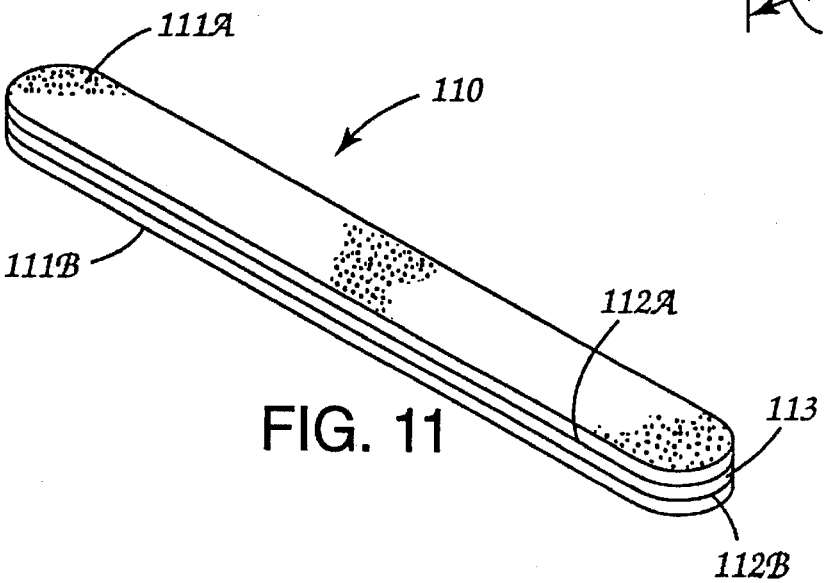
FIG. 11 is a perspective view of yet another type of nail tool of the present invention.

In FIG. 11, another embodiment of a nail board of the invention is shown. The nail board 110 generally comprises a rigid substrate, 113, such as a wood material, onto which adhesive films 112A and 112B (without foam) are disposed to fixedly attach abrasive articles 111A and 111B.

The overall shape of the nail tool is not particularly limited. If the nail tool is provided with a rigid board-like substrate, one customary nail board shape can be employed comprising an elongate rectangular wafer-like structure (small thickness) with rounded (non-squared) ends. Again, there is no particular limitation on the shape of the nail board. In a top plan view, the profile shape of the board can include round, square, rectangular, oval, bent oval, tapered oval, and the like. The side edges of the nail board may be tapered to provide comfort.

The overall nail board must be both strong, conformable, and flexible. The nail board should have enough strength to provide a firm surface for the operator to both file and polish the nail. The nail board should also be sufficiently flexible so that the abrasive article can polish the cuticle and the edges of the nail without harming the surrounding skin or tissue. Additionally, it is preferred that the nail board be waterproof throughout by the judicious selection of its constituent layers and materials therein. In many instances, the nail boards are washed and sanitized between uses and thus the nail board should be able to tolerate the washing and sanitization operations.

The substrate can be made out of any material that exhibits the desired strength and flexibility. The substrate is generally planar and has two surfaces, a front and back surface. Typical substrates include plastic materials (e.g., polystyrene), metal sheets, fiberboards, wood, and the like. The substrate typically has a thickness between 0.5 mm to 10 mm, usually between 1 to 5 mm. It is also within the scope of this invention that the abrasive composites be adhered directly or bonded directly to the substrate. In this embodiment, the abrasive slurry is coated into the cavities of the production tool. The substrate is brought into contact with the outer surface of the production tool, such that the abrasive slurry remains in the cavities but also wets the major surface of the substrate. The abrasive slurry is exposed to conditions to cure the binder precursor and form abrasive composites. The production tool is then removed, such that the abrasive composites are bonded or adhered directly to the substrate. It is also feasible to coat the abrasive slurry onto the major surface of the substrate and then bring this into contact with the production tool. The remaining steps are the same as described above. This alternate process eliminates the abrasive backing and the adhesive.

Adhesive layers 92A and 92B are each applied over substrate 93 as the means to secure abrasive article 91A and/or 91B to the substrate 93. The adhesive can be any adhesive or binder type material, preferably a non-water soluble or water-affected material. It is preferred that the adhesive be a two-sided pressure sensitive adhesive tape, more preferably a double-sided foam tape. This foam tape contributes to the flexibility and comformability of the overall nail board. The foam can be open cell or closed cell, preferably polyurethane foam. The thickness of the foam tape ranges between 0.1 mm to 10 mm, typically between 0.5 to 5 mm. An example of such a foam tape is "Fastmount 2132" foam rubber tape, commercially available from Avery Dennison Co. in Painesville, Ohio 44077. It is also within the scope of this invention to use a foam material or other flexible type material inserted between the substrate and the abrasive article. An adhesive would then be used to secure the abrasive article to this foam or other flexible material and then in turn bond this to the substrate.

It is also feasible to bond the abrasive slurry directly to a substrate and not use an attachment means to do so. To make such an article, the slurry is coated onto the substrate, e.g. the board (fiberboard or polystyrene), and brought into contact with the production tool. After curing, the slurry is permanently attached to the substrate.

It is also within the scope of this invention to have an overcoating, not shown in FIG. 9, over the abrasive article. For instance, a loading resistant coating may be placed over the abrasive composites to minimize the amount of nail dust generated during use. Examples of typical loading resistant coatings include: metal salts of fatty acids (e.g., zinc stearate, lithium stearate, calcium stearate, and aluminum stearate), waxes, fluorochemicals, and the like. Additionally, some operators prefer that the abrasive article be overprinted with a colorful design or pattern to enhance the visual appeal of the nail board. Also, there can be printing on the backing of the abrasive article or under the abrasive coating, if the coating is transparent to show the pattern. The resulting nail board of the invention can be used in a wide variety of different applications pertaining to nail care. For instance, the nail board may be used to file or shape the nail. It has been found that the nail board works exceptionally well at shaping artificial nails, commonly referred to as "tips". These "tips" ordinarily are formed of plastic materials, such as acrylic polymeric materials.

Additionally, the nail board may be used to polish or refine the nail surface and/or edges to create a relatively smooth surface finish. It is also within the scope of this invention to use the novel nail tool to remove skin or dead cells from a human or other animal. For instance, the nail tool may be used to remove callouses from a human foot.

If the nail board contains two or more abrasive articles, then the abrasive articles do not necessarily have to be the same in all respects; although at least one abrasive article must meet the overarching requirements regarding the non-identicality of at least one dimension between adjacent composites in the array. One abrasive article could contain abrasive particles that are larger in size than the other abrasive article. Additionally, the abrasive articles could be pigmented with different colors; these different colors could then signify different sizes of abrasive particles. Alternatively, the abrasive articles may have a different pattern or topography.

A wide range of colors in the coated abrasive layer element of a nail board is requested by users of such nail boards. Typically, nail boards are available in white, blue, and pink, among others. It is relatively easy to impart colors into the abrasive articles of this invention employing nonsolvent-based resins curable by exposure to radiation (thermal or actinic), among other things. If the base mineral used has a white hue, such as white aluminum oxide, then UV liquid pigments, such as those available from Milliken Chemical, Spartanburg S.C. under the tradename "REACTINT", can be added to produce virtually any color desired. Exemplary liquid pigments available under the trade name "REACTINT" include trade designations "BLUE X17", "REDX52", "VIOLET X80LT", "ORANGE X38", "RED X26B50", "BLACK X57AB", and "YELLOW X15". The liquid pigments generally are added in a range amount of about 0.1 to about 0.5 parts by weight per 100 parts by weight of the abrasive slurry. Color can also be produced by using colored minerals. Examples of colored minerals include: blue mineral, such as available under the trade designation 321 Cubitron™, available from 3M Company, St. Paul, Minn., 55144; green mineral such as green silicon carbide; and shades of gray obtained by blending carbon black particles with white fused aluminum oxide.

The proper topography of abrasive composites in the abrasive article is used to minimize scribing in the nail board environment. In general, the abrasive composites can be about about 50 to about 381 micrometers (i.e., about 2 to about 15 mils) in height.

Two preferred topographies included five-sided (i.e., four exposed side faces plus a base side) pyramids, where the pyramids are not all identical. One particular topography has pyramids approximately 178 micrometers in height, with bases ranging from about 79 to 356 micrometers. A second topography has pyramids approximately 355 micrometers in height, with bases ranging from about 158 to 710 micrometers.

The nail boards of this invention demonstrate many advantages. For instance, the nail board tool of the invention does not appreciably grab the fingernail, which can be the case with nail boards using conventional coated abrasive products, and thus a smoother finish on the fingernail is achieved. Further, the nail board of the invention is easier to handle by the operator as it does not cut or abrade the operator's hand, which is a problem sometimes experienced with nail boards which utilize conventional coated abrasives. Also, the nail boards are capable of being periodically cleaned and sanitized by flushing with liquids (e.g., flushed with water or alcohol) without degrading the abrasive article or other layers of the nail tool of this invention. The use of radiation cured resins in the abrasive articles employed in the nail boards of this invention provides tolerance to cleaning by liquids.

Figure 10:
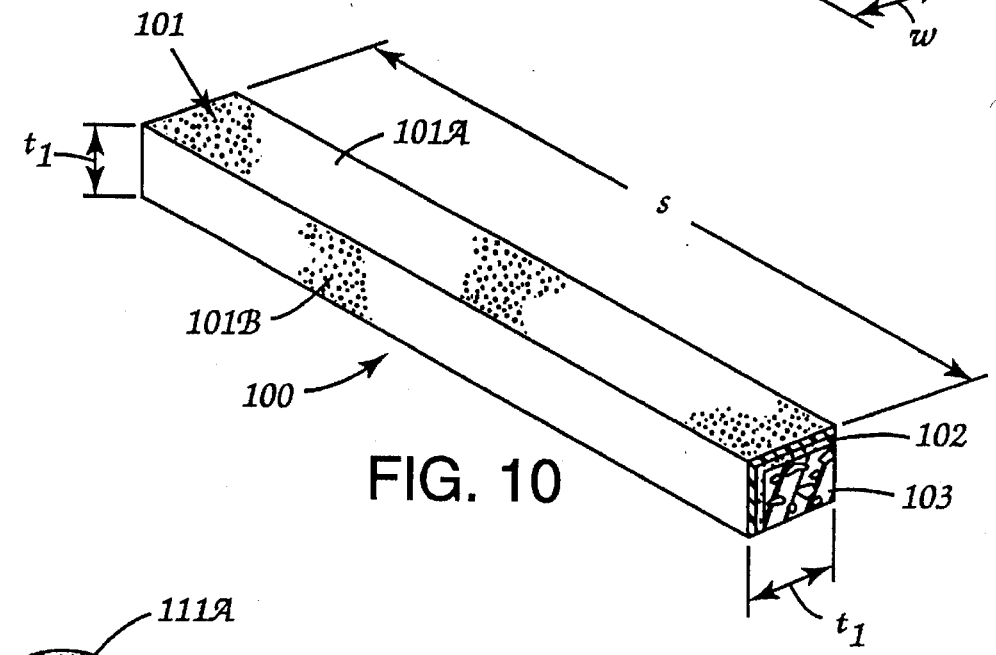
FIG. 10 is a perspective view of another type of nail tool of the present invention.

FIG. 10 is an enlarged perspective view of another embodiment of a nail tool of the invention. In FIG. 10, nail tool 100 includes an abrasive article 101, in cut sheet form, secured to at least one side of a three-dimensional flexible block 103 by an intervening adhesive layer 102. Although not particularly limited, for nail tool applications, flexible block 103 generally can have a major side length s of from about 6 cm to about 13 cm and a thickness $t_1$ of 3 mm to 35 mm. The rectangular block 103 is comprised of a flexible material, which is typically a foam, e.g., a closed cell or open cell polyurethane foam. The abrasive article 101 is adhered to one or more sides of this rectangular block 103, such as on two adjoining sides of block 103, as depicted in FIG. 10. The abrasive article can be cut in sheet form to a size which fits a single side or face of the block 103, and then separate sheets 101A and 101B of the abrasive article 101 are applied to each desired face of the block 103, or alternatively, a single sheet of abrasive article 101 can be cut to a size which can be folded over to fit the sizes of two adjoining faces of the block 103. The abrasive article 101 can be bonded to the flexible block 103 by any conventional crosslinked adhesive or pressure sensitive adhesive or the double-sided pressure-sensitive foam tape described above. The resulting nail tool is flexible enough to polish the corners of nails and also the nail surface near the cuticle.

Method of Refining a Workpiece Surface

Another embodiment of this invention pertains to a method of refining a workpiece surface, especially a fingernail or toenail, including artificial and natural nails. This method involves bringing into frictional contact the abrasive article with a workpiece, e.g., the nail. The term "refine" means that a portion of the workpiece, e.g., nail, is abraded away by the abrasive article.

Workpiece

The focus of this invention is on providing an improved nail tool and method for filing, polishing and/or huffing a nail surface. However, it is to he understood that the abrasive articles that are used in the nail tool of this invention also can he employed to abrade many other types of materials such as metal, metal alloy, exotic metal alloy, ceramic, glass, wood, wood like material, composites, painted surface, plastic, reinforced plastic, stone, and combinations thereof. The workpiece may he flat or may have a shape or contour associated with it. Examples of workpieces include glass ophthalmic lenses, plastic ophthalmic lenses, glass television screens, metal automotive components, plastic components, particle hoard, cam shafts, crank shafts, furniture, turbine blades, painted automotive components, magnetic media, and the like.

In general, depending upon the application, the force at the abrading interface can range from about 0.1 kg to over 1000 kg. Generally this range is between 1 kg to 500 kg of force at the abrading interface. Also depending upon the application, there may be a liquid present during abrading. This liquid can be water and/or an organic compound. Examples of typical organic compounds include lubricants, oils, emulsified organic compounds, cutting fluids, soaps, or the like. These liquids may also contain other additives such as defoamers, degreasers, corrosion inhibitors, or the like. The abrasive article may oscillate at the abrading interface during use. In some instances, this oscillation may result in a finer surface on the workpiece being abraded.

Figure 8:
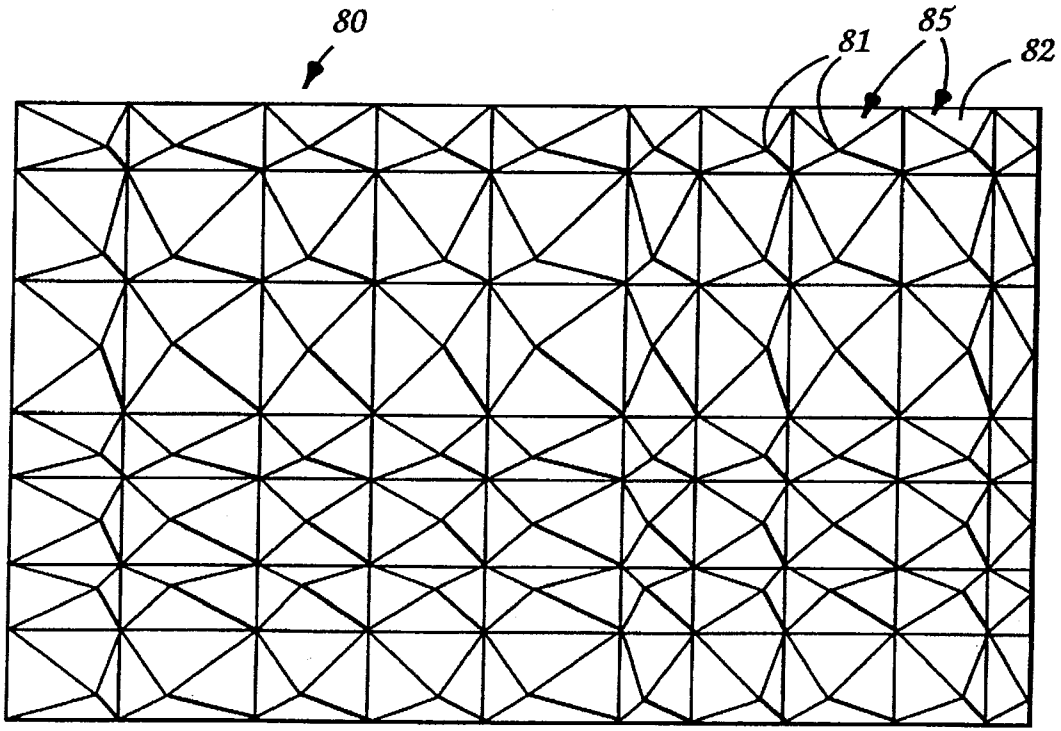
FIG. 8 is a schematic plane view of the topography of an abrasive article used in the nail tool of the present invention having pyramidal shapes for all the abrasive composites, wherein adjacent shapes have the same height but different side angles.

An abrasive composite having an adjacent abrasive composite with a different dimension attributes to this relatively fine surface finish. Since a portion of the abrasive composites have different dimensions, the abrasive composites may not perfectly align in a row from the perspective of the apices of pyramidal shapes and the like. For example, FIG. 8 includes a representative topographical top view (and side views) of an abrasive article 85 of the invention wherein an abrasive composite therein is designated 80 having a face 82 and apex 81. As seen in FIG. 8, the pyramidal shapes, as a whole, align in rows, and therefore, the apices of the abrasive composites are aligned irrespective of the differences in side dimensions between adjacent abrasive composites facing each other across common grooves. This arrangement results in scratches imparted into the workpiece by the abrasive composites which are continuously crossed over. This continuous crossing of previous scratches results, in the aggregate, in the finer surface finish.

The abrasive article used in the nail tool of the invention can be used by hand or used in combination with a machine. At least one or both of the nail tool, and, hence, the abrasive article, and the workpiece, e.g. a nail, is moved relative to the other.

For applications other than filing and buffing nails, the abrasive article can be converted into a belt, tape rolls, disc, sheet, and the like. For belt applications, the two free ends of an abrasive sheet are joined together and a splice is formed. It is also within the scope of this invention to use a spliceless belt.

Generally the endless abrasive belt traverses over at least one idler roll and a platen or contact wheel. The hardness of the platen or contact wheel is adjusted to obtain the desired rate of cut and workpiece surface finish. The abrasive belt speed ranges anywhere from about 150 to 5000 meters per minute, generally between 500 to 3000 meters per minute. Again this belt speed depends upon the desired cut rate and surface finish. The belt dimensions can range from about 5 mm to 1 meter wide and from about 5 cm to 10 meters long. Abrasive tapes are continuous lengths of the abrasive article. They can range in width from about 1 mm to 1 meter, generally between 5 mm to 25 cm. The abrasive tapes are usually unwound, traverse over a support pad that forces the tape against the workpiece and then rewound. The abrasive tapes can be continuously feed through the abrading interface and can be indexed. The abrasive disc, which also includes what is known in the abrasive art as "daisies", can range from about 50 mm to 1 meter in diameter. Typically abrasive discs are secured to a back-up pad by an attachment means. These abrasive discs can rotate between 100 to 20,000 revolutions per minute, typically between 1,000 to 15,000 revolutions per minute.

The features and advantages of the present invention will be further illustrated by the following non-limiting examples. All parts, percentages, ratios, and the like, in the examples are by weight unless otherwise indicated.

EXPERIMENTAL PROCEDURE

The following abbreviations are used throughout:

TMPTA: trimethylol propane triacrylate;

TATHEIC: triacrylate of tris(hydroxy ethyl) isocyanurate;

PH2: 2-benzyl-2-N,N-dimethylamino-1-(4-morpholinophenyl)-1-butanone, commercially available from Ciba Geigy Corp. under the trade designation "Irgacure 369";

ASF: amorphous silica filler, commercially available from DeGussa under the trade designation "OX-50";

FAO: fused heat treated aluminum oxide;

WAO: white fused aluminum oxide; and

SCA: silane coupling agent, 3-methacryloxypropyltrimethoxysilane, commercially available from Union Carbide under the trade designation "A-174".

General Procedure for Making the Abrasive Article

An abrasive slurry was prepared from the materials described in the examples below. The slurry was mixed for about 20 minutes at 1200 rpm using a high shear mixer.

The abrasive article was then made by a method and arrangement generally depicted in FIG. 3. This process was a continuous process that operated at about 15.25 meters/minute. The backing was a 76 micrometer thick polyethylene terephthalate film having a 12 micrometer thick primer coating of ethylene acrylic acid applied on the coated surface. The abrasive slurry was knife-coated onto a production tool (described below) with a knife gap as stated in each example below. The nip pressure, such as exerted by roll 47 in FIG. 3, between the production tool and the backing was about 18 kg. The energy source to cure the abrasive slurry was one "D" type bulb visible light source made by Fusion Systems, Co., which operated at 600 watts/inch (240 watts/cm).

Production Tool

The production tool was a continuous web made from a polypropylene sheet material commercially available from Exxon under the trade designation "PolyPro 3445". The production tool was embossed off of a nickel-plated master. The master tool was made by diamond cutting a pattern of varying dimension grooves and indentations according to the computer programs described in the APPENDIX, and then nickel plated. The APPENDIX includes a pseudo-code of the source code for four computer programs, which, in general, comprises a first program entitled "VARI-1.BAS", which generated and determined random left and right angles for side surfaces of five sided pyramidal shapes and also the material included angles for these shapes; the second program entitled "VARI-STAT.BAS" statistically tallied the number and values of the left, right, and material included angles in x and y coordinates in the array of shapes to assure randomness; the third program entitled "TOP-VIEW.BAS" took the random angle file and calculated where the valleys and peaks appear for the shapes having the angles determined by the first program for a square inch (6.5 $cm^2$) and printed out a display on a computer screen or printer of the topography of the array of shapes; and the fourth program "MAKETAPE.BAS" took the determined angles and generated a code to control the number and type of grooves required to be cut by the diamond turning machine to make a 22.5 inch (57 cm) wide pattern of random shapes generated by the first program.

In general, the production tool, as made from the master tool made using the above-mentioned four programs, contained an array of cavities that were inverted five-sided pyramids (inclusive of the mouth of the cavity as a "base"). Two different tools were used, with the following dimensions: Production Tool #1 was a five sided pyramid (inclusive of the mouth of the cavity as a "base") that had a constant depth of about 355 micrometers but varied in dimension between 8 and 45 degrees for adjacent cavities in terms of the angle made by side faces with the intersection of a plane extending normal to the plane of tool and the material included angle or apex angle or each composite was at least 25 degrees. Production Tool #2 was similar to Production Tool #1 except that the depth of the cavities was about 180 micrometers.

Incorporation of Abrasive Article into Nail Board

The abrasive article of each example, made by the method above, was incorporated into a nail tool product, in this case a nail board.

In this regard, a 0.79 mm (1/32") thick, polyurethane pressure sensitive double sided tape, commercially available from Avery Corporation under the trade designation "Volera" was adhered to the backside of the abrasive article. Two abrasive articles were adhered, one to each side of a rigid polystyrene substrate, 1.59 mm (1/16") thick. This is widely used and known, using the side of the polyurethane tape not having the abrasive article thereon. This laminate construction was cut using a die to an elongated elliptical shape, approximately 2 cm wide and 18 cm long. The resulting nail board had a shape which generally resembled FIG. 9.

EXAMPLES 1–3

The nail boards of Examples 1 through 3 were prepared using the materials listed below in Table 1. The production tool used was Production Tool #1, a knife gap of about 115 micrometers was provided, and a run speed of about 7.62 meters/minute was used.

TABLE 1

| | Example 1 | Example 2 | Example 3 |
|---|---|---|---|
| TMPTA | 22.2 | 20.6 | 20 |
| TATHEIC | 9.5 | 8.8 | 8.6 |
| PH2 | 0.3 | 0.3 | 0.3 |
| SCA | 1.1 | 1.1 | 2.5 |
| ASF | 1.1 | 2.2 | 2.5 |
| WAO | 65.7 | 66.9 | 66 |
| mineral grade | P-320 | P-180 | P-100 |

The abrasive article formed was then used as a constituent element in the making of a nail board according to the above-described procedure entitled "Incorporation of Abrasive Article into Nail Board". The resulting nail board, when then used to buff the edges of human finger nails with back-and-forth movement of the major plane of the abrasive article against the nail end surfaces, visibly refined the human nails as the refined nail surfaces were left smooth and uniform, and the nail material removed was in the form of a fine powdery substance indicating fine polishing.

EXAMPLES 4–6

Example 4 was prepared using the materials listed below in Table 2. The production tool used was Production Tool #2 and the knife gap was about 76 micrometers. Pigment was added to the abrasive slurry, at a level of 0.1 parts per 1000 parts of abrasive slurry. The liquid pigment used had the trade designation "RED X52", available under the trade name "REACTINIT" from Milliken Chemicals.

Example 5 and 6 were prepared using the materials listed below in Table 2. The production tool used was Production Tool #2 and the knife gap was about 76 micrometers. Encapsulated fragrance 3M Microencapsulated Products 32 μ capsule 70070503183 was added to the abrasive slurry of Example 6. Example 6 was coated directly onto the polyurethane foam tape, 0.79 mm thick, commercially available from Avery Corporation under the trade designation "VOLERA". The abrasive article of Example 6 was then directly adhered to the rigid substrate by a double sided tape, rather than by the polyurethane foam tape.

TABLE 2

| | Example 4 | Example 5 | Example 6 |
|---|---|---|---|
| TMPTA | 20.0 | 20.2 | 19.2 |
| TATHEIC | 8.6 | 8.6 | 8.2 |
| PH2 | 0.29 | 0.29 | 0.27 |
| SCA | 1 | 1 | 1 |
| ASF | 1 | 1 | 1 |
| fragrance | 0 | 0 | 4.7 |
| WAO | 69 | 69 | 65.3 |
| mineral grade (μm) | 40 | 40 | 40 |

The abrasive article then was used as a constituent element in the making of a nail board according to the above-described procedure entitled "Incorporation of Abrasive Article into Nail Board". The resulting nail board, when then used to buff the edges of human finger nails with back-and-forth movement of the major plane of the abrasive article against the nail end surfaces, also visibly refined the human nails as the refined nail surfaces were left smooth and uniform, and the nail material removed was in the form of a fine powdery substance indicating fine polishing.

EXAMPLES 7–9

Examples 7 through 9 were prepared using the materials listed below in Table 3. The production tool used was Production Tool #2 and the knife gap was about 102 micrometers.

TABLE 3

| | Example 7 | Example 8 | Example 9 |
|---|---|---|---|
| TMPTA | 20 | 20 | 19.8 |
| TATHEIC | 8.5 | 8.5 | 8.4 |
| PH2 | 0.28 | 0.28 | 0.28 |
| SCA | 2 | 2 | 3 |
| ASF | 1 | 1 | 1 |
| FAO | 68.2 | 68.2 | 67.5 |
| mineral grade | P-320 | P-180 | P-100 |

The abrasive article then was used as a constituent element in the making of a nail board according to the above-described procedure entitled "Incorporation of Abrasive Article into Nail Board". The resulting nail board, when then used to buff the edges of human finger nails with back-and-forth movement of the major plane of the abrasive article against the nail end surfaces, also visibly refined the human nails as the refined nail surfaces were left smooth and uniform, and the nail material removed was in the form of a fine powdery substance indicating fine polishing.

Various modifications and alterations of this invention will become apparent to those skilled in the art without departing from the scope and spirit of this invention, and it should be understood that this invention is not to be unduly limited to the illustrative embodiments set forth herein.

Appendix

```
'*****************************
'**Program : VARI-1.BAS      *
*****************************
' VARI-1.BAS - Creates random left and right half angles
'
DECLARE SUB showangles ()
DIM SHARED LEFTANG(3000) AS INTEGER
DIM SHARED RIGHTANG(3000) AS INTEGER
'******* Begin Main Program *****
PI = 3.141592654#
RANDOMIZE TIMER
CLS
INPUT "WHAT IS THE TOOL ANGLE  ", ToolAng
INPUT "WHAT IS THE MINIMUM HALF ANGLE  ", MinHalfAng
INPUT "WHAT IS THE MAXIMUM HALF ANGLE  ", MaxHalfAng
INPUT "WHAT IS THE MINIMUM INCLUDED ANGLE OF THE MATERIAL  ",
MinInclAng
ANG1 = 45
'ANG1 is the previous grooves Right half angle
'ANG1 & 2 are used to check the MinInclAng
FOR I =  1 TO 2500 STEP 2
      '** Calculate Odd Numbered Groove Angles ****
      FOR T = 1 TO INT(RND * 100 + 1): NEXT T
'This is a random delay
      IF MinInclAng - ANG1 > MinHalfAng THEN
        min = MinInclAng - ANG1
      ELSE
        min = MinHalfAng
      END IF
      LEFTANG(I) = INT(RND * (MaxHalfAng - min + 1)+ min)
      IF ToolAng - LEFTANG(I) > MinHalfAng THEN
         min = ToolAng - LEFTANG(I)
      ELSE
         min = MinHalfAng
      END IF
      RIGHTANG(I) = INT(RND * (MaxHalfAng - (min) + 1) + (min))
      ANG2 = RIGHTANG(I)
      '** End Calculate Odd Number Groove angles **
      '** Begin Calculating Even Numbered Groove angles **
FOR T = 1 TO INT(RND * 100 + 1): NEXT T
'This is a random delay
RIGHTANG(I + 1) = INT(RND * (MaxHalfAng - MinHalfAng + 1) +
MinHalfAng)
```

```
IF ToolAng - RIGHTANG(I + 1) > MinHalfAng THEN
   min = ToolAng - RIGHTANG(I + 1)
ELSE
   min = MinHalfAng
END IF
IF MinInclAng - ANG2 > min THEN
   min = MinInclAng - ANG2
ELSE
   min = min
END IF
LEFTANG(I + 1) = INT(RND * (MaxHalfAng - (min) 1) + (min))
ANG1 = RIGHTANG(I + 1)
'** End Calculating Even Numbered Groove Angles **

NEXT I
CALL showangles
OPEN "RANANG.TXT" FOR OUTPUT AS #3
PRINT #3, "RANDOM ANGLE GENERATOR"
PRINT #3, "LEFT ANG   RIGHT ANG"
FOR I = 1 TO 2500
  PRINT #3, LEFTANG(I); RIGHTANG(I)
NEXT I

CLOSE 3

'****************** End Main Program*************
'
SUB showangles 'This subroutine shows the first 30 grooves

CLS
SCREEN 9
COLOR 3
SLEEP 2
PI    3.141592654#
      FOR I = 1 TO 30
         'LOCATE 1, 1: PRINT LEFTANG(I), RIGHTANG(I), LEFTANG(I) +
RIGHTANG(I)
         A = (TAN(LEFTANG(I) * PI / 180) * 200)
         LINE (200, 100)-(200 - A, 300), 3
         B = (TAN(RIGHTANG(I) * PI / 180) * 200)
         LINE (200, 100)-(200 + B, 300), 3
         FOR T = 1 TO 200000: NEXT T
         LINE (200, 100)-(200 - A, 300), 0
         LINE (200, 100)-(200 + B, 300), 0
```

```
      NEXT I
END SUB
```

---

```
'******************************
'** Program : VARISTAT.BAS   *
*****************************

DECLARE SUB SETGRAPH2 ()       'Graph for Included Angles
DECLARE SUB ANGLEGEN ()        'Main Subroutine
DECLARE  SUB XGEN ()           'Subroutine for Tests only
DECLARE  SUB SETGRAPH ()       'Graph for Half Angles
DIM SHARED ANGLEFT(2501) AS INTEGER     'Array for left half
angles Direction 1
DIM SHARED ANGRIGHT(2501) AS INTEGER    'Array for right half
angles Direction 1
DIM SHARED ANGLEFT2(2501) AS INTEGER    'Array for left half
angles Direction 2
DIM SHARED ANGRIGHT2(2501) AS INTEGER   'Array for right half
angles Direction 2
DIM SHARED HALF(8 TO 45) AS INTEGER     'Array to tally number of
angles between 8 and 45 Direction 1
DIM SHARED HALF2(8 TO 45) AS INTEGER    'Array to tally number of
angles between 8 and 45 Direction 2
DIM SHARED ACCUM(0 TO 100) AS INTEGER   'Array to tally number of
included angles between 40 and 90 Dir
DIM SHARED ACCUM2(0 TO 100) AS INTEGER  'Array to tally number of
included angles between 40 and 90 Dir

CLS
CALL ANGLEGEN
'CALL  XGEN  'This was for test purposes only
SUB  ANGLEGEN
CALL SETGRAPH
OPEN "RANANG.TXT" FOR INPUT AS #3
'Two different .TXT files would have been created, however here we
use the same file
OPEN "RANANG.TXT" FOR INPUT AS #4
INPUT #3,  A$
INPUT #3,  B$
INPUT #4,  A$
INPUT #4,  B$
FOR I = 1 TO 2500
```

```
        INPUT #3, ANGLEFT(I)
        INPUT #3, ANGRIGHT(I)
        INPUT #4, ANGLEFT2(I)
        INPUT #4, ANGRIGHT2(I)
NEXT  I
CLOSE 3, 4

FOR I = 1 TO 2500
    HALF(ANGLEFT(I)) = HALF(ANGLEFT(I)) + 1
    HALF2(ANGRIGHT(I)) = HALF2(ANGRIGHT(I)) + 1
NEXT I

LOCATE 2, 10: COLOR 11
PRINT  "First Direction Total Left Half Angle"
LOCATE 3, 10: COLOR  12
PRINT  "First Direction Total Right Half Angle"

FOR I = 8 TO 45
   LINE (I, O)-(I, HALF(I)), 11
   LINE (I + .5, 0)-(I + .5, HALF2(I)), 12
   HALF(I) = 0
   HALF2(I) = 0
NEXT I
SLEEP

CALL SETGRAPH
LOCATE 2, 10: COLOR 11
PRINT "Second Direction Total Left Half Angle"
LOCATE 3, 10: COLOR 12
PRINT "Second Direction Total Right Half Angle"

FOR I = 1 TO 2500
    HALF(ANGLEFT2(I)) = HALF(ANGLEFT2(I)) + 1
    HALF2(ANGRIGHT2(I)) = HALF2(ANGRIGHT2(I)) + 1
NEXT I

FOR I = 8 TO 45
   LINE (I, O)-(I, HALF(I)), 11
   HALF(I) = 0
   LINE (I + .5, 0)-(I + .5, HALF2(I)), 12
   HALF2(I) = 0
NEXT I
SLEEP
```

```
CALL SETGRAPH2
LOCATE 2, 10: COLOR 11
PRINT "First Direction Total Included Angles (Left + Right Half
Angle)"
LOCATE 3, 10: COLOR 12
PRINT "Second Direction Total Included Angles (Left + Right Half
Angle)"

FOR I = 1 TO 2500
   ACCUM(ANGLEFT(I) + ANGRIGHT(I)) = ACCUM(ANGLEFT(I) +
ANGRIGHT(I)) + 1
   ACCUM2(ANGLEFT2(I) + ANGRIGHT2(I)) = ACCUM2(ANGLEFT2(I) +
ANGRIGHT2(I)) + 1
NEXT I
FOR I = 40 TO 90
    LINE (I, 0)-(I, ACCUM(I)), 11
    ACCUM(I) = 0
    LINE (I + .5, 0)-(I + .5, ACCUM2(I)), 12
    ACCUM2(I) = 0
NEXT I
SLEEP
END SUB

SUB SETGRAPH

SCREEN 9
WINDOW (4, -30)-(50, 200)
CLS

LINE (6, 0)-(6, 200), 3
LINE (6, 0)-(50, 0), 3
LINE (6, 195)-(50, 195), 3
LINE (6, 105)-(50, 105), 3
LINE (6, 50)-(50, 50), 3
LINE (6, 150)-(50, 150), 3
LOCATE 23, 7: PRINT "8"
LOCATE 23, 72: PRINT "45"
LOCATE 23, 40: PRINT "27"
LOCATE 22, 3: PRINT "1"
LOCATE 1, 1: PRINT "200"
LOCATE 11, 1: PRINT "100",
END SUB

SUB SETGRAPH2
```

```
SCREEN 9
WINDOW (37, -30)-(95, 200)
CLS

LINE (39, 0)-(39, 200), 3
LINE (39, 0)-(95, 0), 3
LINE (39, 198)-(95, 198), 3
LINE (39, 102)-(95, 102), 3
LINE (39, 50)-(95, 50), 3
LINE (39, 150)-(95, 150), 3
LOCATE 23, 4: PRINT "40"
LOCATE 23, 73: PRINT "90"
LOCATE 23, 39: PRINT  "65"
LOCATE 22, 3: PRINT "1"
LOCATE 1, 1: PRINT "200"
LOCATE 11, 1: PRINT "100"
END SUB

SUB XGEN    'This subroutine was for test purposes only

CALL SETGRAPH
OPEN "RANANG.TXT" FOR INPUT AS #3
INPUT #3, A$
INPUT #3, B$
FOR I = 1 TO 2500
  INPUT #3, ANGLEFT(I)
  INPUT #3, ANGRIGHT(I)
NEXT I
FOR I = 1 TO 2500
    HALF(ANGLEFT(I)) = HALF(ANGLEFT(I)) + 1
NEXT I

FOR I = 8 TO 45
   LINE (I, 0)-(I, HALF(I)), 11
   HALF(I) = 0
NEXT I
SLEEP

CALL SETGRAPH
FOR I = 1 TO 2500
    HALF(ANGRIGHT(I)) = HALF(ANGRIGHT(I)) + 1
NEXT I
FOR I = 8 TO 45
   LINE (I, 0)-(I, HALF(I)), 11
```

```
   HALF(I) = 0
NEXT I
SLEEP
CALL SETGRAPH2
FOR I = 1 TO 2500
   ACCUM(ANGLEFT(I) + ANGRIGHT(I)) = ACCUM(ANGLEFT(I) +
ANGRIGHT(I)) + 1
NEXT I
FOR I = 40 TO 90
    LINE (I, 0)-(I, ACCUM(I)), 11
    ACCUM(I) = 0
NEXT I
SLEEP
END SUB
```

---

```
****************************
'** Program : TOPVIEW.BAS    *
****************************
'* In general it takes the random angle data file, calculates
where the valleys and peaks are, draws black straight lines for
the valleys, then connects the peaks across the diagonal.  Then it
displays the output on the screen or an HP 7475 plotter.  *
****************************
DECLARE SUB PLOTPEAKS ()
DECLARE SUB PLOTDOTS ()
DECLARE SUB LINES ()
DECLARE SUB DIAGONAL ()
DIM SHARED ML(2500) AS INTEGER
DIM SHARED MR(2500) AS INTEGER
DIM SHARED NL(2500) AS INTEGER
DIM SHARED NR(2500) AS INTEGER

DIM SHARED M(5000) AS DOUBLE
DIM SHARED N(5000) AS DOUBLE
COMMON SHARED PI, X, GROOVES
PI = 3.141592654#

GROOVES = 1000
OPEN "RANANG.TXT" FOR INPUT AS #2
OPEN "RANANG.TXT" FOR INPUT AS #3
```

```
INPUT "ENTER IN THE SQUARE SIZE YOU WOULD LIKE (.2 -> 1.5 INCHES)
", X

INPUT #2, A$
INPUT #2, B$
FOR I = 1 TO GROOVES
  INPUT #2, ML(I)
  INPUT #2, MR(I)
NEXT I
CLOSE 2

INPUT #3, A$
INPUT #3, B$
FOR I = 1 TO GROOVES
   INPUT #3, NL(I)
   INPUT #3, NR(I)
NEXT I
CLOSE 3

FOR I = 1 TO GROOVES
  M(I * 2 - 1) = M((I - 1) * 2) + TAN(ML(I) * PI / 180) * .014
  M(I * 2) = M(I * 2 - 1) + TAN(MR(I) * PI / 180) * .014
  N(I * 2 - 1) = N((I - 1) * 2) + TAN(NL(I) * PI / 180) * .014
  N(I * 2) = N(I * 2 - 1) + TAN(NR(I) * PI / 180) * .014
NEXT I

LOCATE 15, 15
INPUT "Would you like to see the data on the (S)creen or
(P)lotter", ans$
ans$ = UCASE$(ans$)

IF ans$ = "S"  THEN
   SCREEN 9
   COLOR 0
   WINDOW SCREEN (-(X / 10), -(X / 10))-(X, (X + X / 10) * (.75 -
.75 * .138))
   PAINT (X / 2, X / 2), 15
   CALL LINES
   SLEEP
   CLS
   PAINT (X / 2, X / 2), 15

   CALL DIAGONAL
END IF
```

```
IF ans$ = "P" THEN
   CALL PLOTDOTS
   CALL PLOTPEAKS

   SLEEP
END IF

SUB DIAGONAL
FOR I = 1 TO GROOVES * 2 STEP 2
  'LINE (M(I), N(1))-(M(I), 10)
  'LINE (M(1), N(I))-(10, N(I))
NEXT I

FOR I = 1 TO GROOVES * 2 - 2 STEP 2
  LINE (M(I), -.014)-(M(I + 1), 0)
  LINE (M(I + 1), 0)-(M(I + 2), -.014)
NEXT I

LINE (M(1), -.014)-(M(1), -.02)
LINE -(M(GROOVES * 2 - 2), -.02)
LINE -(M(GROOVES * 2 - 2), -.014)
FOR I = 1 TO GROOVES * 2 - 2 STEP 2
  LINE (-.014, N(I))-(0, N(I + 1))
  LINE (0, N(I + 1))-(-.014, N(I + 2))
NEXT I
LINE (-.014, N(1))-(-.02, N(1))
LINE -(-.02, N(GROOVES * 2 - 2))
LINE -(-.014, N(GROOVES * 2 - 2))

FOR NN = 2 TO GROOVES * 2 - 2 STEP 2
  FOR MM = 2 TO GROOVES * 2 - 2 STEP 2
      'LINE (M(MM), N(NN))-(M(MM + 1), N(NN + 1)), 2
      'LINE (M(MM), N(NN))-(M(MM + 1), N(NN - 1)), 4
      'LINE (M(MM), N(NN))-(M(MM - 1), N(NN + 1)), 4
      'LINE (M(MM), N(NN))-(M(MM - 1), N(NN - 1)), 2
      LINE (M(MM), N(NN))-(M(MM + 2), N(NN + 2)), 2
      'LINE (M(MM), N(NN))-(M(MM + 2), N(NN - 2)), 4
      PSET (M(MM), N(NN)), 4
      IF M(MM - 1) > X THEN GOTO STOPMM
      IF N(NN - 1) > (X + X / 10) * (.75 - .75 * .138) THEN GOTO
STOPNN
  NEXT MM
STOPMM:
NEXT NN
```

```
'PAINT (M(5) + (M(6) - M(5)) / 2, N(6) - (N(6) - N(5)) / 2), 11
'CIRCLE (M(5) + (M(6) - M(5)) / 2, N(6) - (N(6) - N(5)) / 2),
.001, 11
STOPNN:
BEEP
END SUB

SUB LINES
FOR I = 1 TO 200 STEP 2
  LINE (M(I), N(1))-(M(I), 10)
  LINE (M(1), N(I))-(10, N(I))
NEXT I

FOR I = 1 TO 198 STEP 2
  LINE (M(I), -.014)-(M(I + 1), 0)
  LINE (M(I + 1), 0)-(M(I + 2), -.014)
NEXT I
LINE (M(1), -.014)-(M(1), -.02)
LINE -(M(198), -.02)
LINE -(M(198), -.014)
FOR I = 1 TO 198 STEP 2
  LINE (-.014, N(I))-(0, N(I + 1))
  LINE (0, N(I + 1))-(-.014, N(I + 2))
NEXT I
LINE (-.014, N(1))-(-.02, N(1))
LINE -(-.02, N(198))
LINE -(-.014, N(198))

FOR NN = 2 TO 198 STEP 2
  FOR MM = 2 TO 198 STEP 2
      LINE (M(MM), N(NN))-(M(MM + 1), N(NN + 1)), 2
      LINE (M(MM), N(NN))-(M(MM + 1), N(NN - 1)), 4
      LINE (M(MM), N(NN))-(M(MM - 1), N(NN + 1)), 4
      LINE (M(MM), N(NN))-(M(MM - 1), N(NN - 1)), 2
      IF M(MM - 1) > X THEN GOTO 300
      IF N(NN - 1) > (X + X / 10) * (.75 - .75 * .138) THEN GOTO
200
  NEXT MM
300
NEXT NN
'PAINT (M(5) + (M(6) - M(5)) / 2, N(6) - (N(6) - N(5)) / 2), 11
'CIRCLE (M(5) + (M(6) - M(5)) / 2, N(6) - (N(6) - N(5)) / 2),
.001, 11
200
```

```
BEEP
END SUB

SUB PLOTDOTS
'WINDOW SCREEN (-(X / 10), -(X / 10))-(X, (X + X / 10) * (.75 -
.75 * .138))

OPEN "COM1:9600,S,7,1,RS,CS65535,DS,CD" FOR RANDOM AS #4
'PRINT #4, USING "IP; SC##.#####,##.#####,##.#####,##.#####;"; (-
(X / 10)); (X); (-(X / 10)); ((X + X / 10
'PRINT #4, USING "IP250,596,7470,7796;
SC##.#####,##.#####,##.#####,##.#####;"; 0; 4; 0; 3
PRINT #4, "IN;IP250,596,7443,7796; SC0,1,0,1;"
PRINT #4, "VS30;"
PRINT #4, "SP1;"

FOR I = 1 TO GROOVES * 2 STEP 2
  'LINE (M(I), N(1))-(M(I), 10)
  'LINE (M(1), N(I))-(10, N(I))
NEXT I

PRINT #4, USING "PA ##.#####, -.014;"; M(1)
PRINT #4, "PD;"

FOR I = 2 TO GROOVES * 2 - 2 STEP 2
  'LINE (M(I), -.014)-(M(I + 1), 0)
  PRINT #4, USING "PA ##.#####, 0"; M(I)
  'LINE (M(I + 1), 0)-(M(I + 2), -.014)
  PRINT #4, USING "PA ##.#####,-.014"; M(I + 1)
  P = I + 1
  IF M(I + 1) > X THEN GOTO 600
NEXT I
600
'LINE (M(1), -.014)-(M(1), -.02)
PRINT #4, USING "PA ##.#####, -.03;"; M(P)
'LINE -(M(P), -.02)
PRINT #4, USING "PA ##.#####, -.03;"; M(1)
'LINE -(M(P), -.014)
PRINT #4, USING "PA ##.#####,-.014;PU;"; M(1)
PRINT #4, USING "PA -.014,##.#####;PD;"; N(1)
FOR I = 2 TO GROOVES * 2 - 2 STEP 2
  'LINE (-.014, N(I))-(0, N(I + 1))
  PRINT #4, USING "PA 0,##.#####;"; N(I)
  'LINE (0, N(I + 1))-(-.014, N(I + 2))
```

```
  PRINT #4, USING "PA -.014,##.#####;"; N(I + 1)
  Q = I+ 1
  IF N(I + 1) > X THEN GOTO 700
NEXT I
700
'LINE (-.014, N(1))-(-.02, N(1))
PRINT #4, USING "PA -.03,##.#####;"; N(Q)
'LINE -(-.02, N(Q))
PRINT #4, USING "PA -.03,##.#####;"; N(1)
'LINE -(-.014, N(Q))
PRINT #4, USING "PA -.014,##.#####;PU;"; N(1)
PRINT #4, "SP4;"

PRINT #4, USING "PA ##.#####,##.#####;PD;"; M(2); N(2)
A = 2
FOR B = 2 TO P STEP 2
  FOR COUNT = 0 TO Q - 1 STEP 2
      'LINE (M(MM), N(NN))-(M(MM + 2), N(NN + 2)), 2
      PRINT #4, USING "PD;PA ##.#####,##.#####;"; M(B + COUNT) N
(A + COUNT)
      IF M(B + COUNT - 1) > X THEN GOTO 400
      IF N(A + COUNT - 1) > X THEN GOTO 400
  NEXT COUNT
400
PRINT #4, "PU;"
PRINT #4, USING "PA ##.#####,##.#####;"; M (B + 2); N (A)
NEXT B

PRINT #4, USING "PA ##.#####,##.#####;PD;"; M(2); N(4)
B = 2
FOR A = 4 TO Q STEP 2
  FOR COUNT = 0 TO P - 1 STEP 2
      'LINE (M(MM), N(NN))-(M(MM + 2), N(NN + 2)), 2
      PRINT #4, USING "PD;PA ##.#####,##.#####;"; M(B + COUNT);
N(A + COUNT)
      IF M(B + COUNT - 1) > X THEN GOTO 401
      IF N(A + COUNT - 1) > X THEN GOTO 401
  NEXT COUNT
401
PRINT #4, "PU;"
PRINT #4, USING "PA ##.#####,##.#####;"; M(B); N(A + 2)
NEXT A

'PRINT #4, "PA.25,.25;PD;PA.75,.25;PA.75,.75;PA.25,.75;PA.25,.25;"
```

```
500
BEEP
CLOSE 4
END SUB
SUB PLOTPEAKS

OPEN "COM1:9600,S,7,1,RS,CS65535,DS,CD" FOR RANDOM AS #4
PRINT #4, "IN;IP250,596,7443,7796; SCO,1,0,1;"

PRINT #4, "VS50;"

PRINT #4, "SP1;"

PRINT #4, USING "PA ##.#####, -.014;"; M(1)
PRINT #4, "PD;"

FOR I = 2 TO GROOVES * 2 - 2 STEP 2
  PRINT #4, USING "PA ##.#####, 0"; M(I)
  PRINT #4, USING "PA ##.#####,-.014"; M(I + 1)
  P = I + 1
  IF M(I + 1) > X THEN GOTO 1600
NEXT I
1600

PRINT #4, USING "PA ##.#####, -.03;"; M(P)
PRINT #4, USING "PA ##.#####, -.03;"; M(1)
PRINT #4, USING "PA ##.#####,-.014;PU;"; M(1)

PRINT #4, USING "PA -.014,##.#####;PD;"; N(1)
FOR I = 2 TO GROOVES * 2 - 2 STEP 2
  PRINT #4, USING "PA 0,##.#####;"; N(I)
  PRINT #4, USING "PA -.014,##.#####;"; N(I + 1)
  Q = I + 1
  IF N(I + 1) > X THEN GOTO 1700
NEXT I
1700

PRINT #4, USING "PA -.03,##.#####;"; N(Q)
PRINT #4, USING "PA -.03,##.#####;"; N(1)
PRINT #4, USING "PA -.014,##.#####;PU;"; N(1)

FOR I = 1 TO P STEP 4
```

```
  PRINT #4, USING "PA
##.#####,##.#####;PD;PA##.#####,##.#####;PU;"; M(I); N(1); M(I);
N(Q)
  PRINT #4, USING "PA
##.#####,##.#####;PD;PA##.#####,##.#####;PU;"; M(I + 2); N(Q); M(I
+ 2); N(1)
NEXT I

FOR I = 1 TO Q STEP 4
  PRINT #4, USING "PA
##.#####,##.#####;PD;PA##.#####,##.#####;PU;"; M(1); N(I); M(P);
N(I)
  PRINT #4, USING "PA
##.#####,##.#####;PD;PA##.#####,##.#####;PU;"; M(P); N(I + 2);
M(1); N(I + 2)
NEXT I

PRINT #4, "SP4;VS20;"

PRINT #4, USING "PA ##.#####,##.#####;"; M(1); N(1)
A = 1
FOR B = 1 TO P STEP 2
  FOR COUNT = 0 TO Q - 1 STEP 1
      PRINT #4, USING "PD;PA ##.#####,##.#####;"; M(B + COUNT);
N(A + COUNT)
      IF M(B + COUNT - 1) > X THEN GOTO 1400
      IF N(A + COUNT - 1) > X THEN GOTO 1400
  NEXT COUNT
1400
PRINT #4, "PU;"
PRINT #4, USING "PA ##.#####,##.#####;"; M(B + 2); N(A)
NEXT B

PRINT #4, "SP3;"
PRINT #4, USING "PA ##.#####,##.#####;"; M(P); N(1)
A = 1
FOR B = P TO 1 STEP -2
  FOR COUNT = 0 TO Q - 1 STEP 1
      PRINT #4, USING "PD;PA ##.#####,##.#####;"; M(B - COUNT);
N(A + COUNT)
      IF B - COUNT 1 = 0 THEN GOTO 2500
      IF A + COUNT = Q THEN GOTO 2500
  NEXT COUNT
2500
```

```
PRINT #4, "PU;"
IF B - 2 <= 0 THEN GOTO 2000
PRINT #4, USING "PA ##.#####,##.#####;"; M(B - 2); N(A)
NEXT B
2000

PRINT #4, "SP4;"
PRINT #4, USING "PA ##.#####,##.#####;"; M(1); N(3)
B = 1
FOR A = 3 TO Q STEP 2
  FOR COUNT = 0 TO P - 1 STEP 1
      PRINT #4, USING "PD;PA ##.#####,##.#####;"; M(B + COUNT);
N(A + COUNT)
      IF M(B + COUNT - 1) > X THEN GOTO 1401
      IF N(A + COUNT - 1) > X THEN GOTO 1401
  NEXT COUNT
1401
PRINT #4, "PU;"
PRINT #4, USING "PA ##.#####,##.#####;"; M(B); N(A + 2)
NEXT A

PRINT #4, "SP3;"
PRINT #4, USING "PA ##.#####,##.#####;"; M(P); N(3)
B = P
FOR A = 3 TO Q STEP 2
  FOR COUNT = 0 TO Q - 1 STEP 1
      PRINT #4, USING "PD;PA ##.#####,##.#####;"; M(B - COUNT);
N(A + COUNT)
      IF B - COUNT - 1 = 0 THEN GOTO 2400
      IF A + COUNT = Q THEN GOTO 2400
  NEXT COUNT
2400
PRINT #4, "PU;"
PRINT #4, USING "PA ##.#####,##.#####;"; M(B); N(A + 2)
NEXT A

BEEP
CLOSE 4
END SUB
```

```
'****************************
'** Program : MAKETAPE.BAS   *
'****************************

'MAKETAPE.BAS
'       1)  Ask for the real tool angle
'       2)  Read in all Left and Right angles
'       3)  Figure out how many grooves it will take to
 make a 22.5 inch wide pattern
'       4)  Write the Code
'
'
'
DECLARE SUB STOPFANUK ()  ' Code to shut down DTM
DECLARE SUB STARTFANUK () ' Code to start up DTM
DECLARE SUB XthenLEFT (A!) ' Code generation for: X move then Left
angle plunge
DECLARE SUB ROTATEthenRIGHT (A!) ' Code generation for: Rotate C
then Right angle plunge
DECLARE SUB XthenRIGHT (A!)  ' Code generation for: X move then
Right angle plunge
DECLARE SUB ROTATEthenLEFT (A!) ' Code generation for: Rotate C
then Left angle plunge

'* LEFT() - array to store the left angle information
'* RIGHT() - array to store the right angle information
'* XMOVE() - array to store the X distance between grooves

DIM SHARED LEFT(2500) AS INTEGER, RIGHT(2500) AS INTEGER
DIM SHARED XMOVE(2500) AS DOUBLE
COMMON SHARED TOOLANG AS DOUBLE, CABS AS DOUBLE, XPOS AS DOUBLE

'******** BEGIN MAIN PROGRAM *********
PI = 3.141592654#

CLS
LOCATE 5, 5
INPUT "WHAT IS THE REAL TOOL ANGLE  ", TOOLANG
INPUT "WHAT IS THE PEAK HEIGHT  ", Height

OPEN "RANANG.TXT" FOR INPUT AS #3     'Opens data file of angles
INPUT #3, A$
INPUT #3, B$
```

```
FOR I = 1 TO 2500  'Reads all Left and Right angles from data file
  INPUT #3, LEFT(I)
  INPUT #3, RIGHT(I)
NEXT I
CLOSE 3


XMOVE(1) = TAN(LEFT(1) * PI / 180) * Height  ' This formula
calculates the  horizontal movement for the first groove

XPOS = XPOS + XMOVE(1)
FOR I = 2 TO 2500
  XMOVE(I) = TAN(RIGHT(I - 1) * PI / 180) *
Height + TAN(LEFT(I) * PI / 180) * Height

' This formula calculates the horizontal movement
  XPOS = XPOS + XMOVE(I)
  P = I
' P is the number of grooves
  IF XPOS > 22.5 THEN GOTO 100
' Checks to make sure our pattern width is < 22.5
NEXT I
100

LOCATE 10, 10: PRINT USING "GROOVES = ####
: PATTERN WIDTH = ##.####"; P; XPOS
XPOS = 0
OPEN "FANUK.TXT" FOR OUTPUT AS #3
PRINT "WRITING TO FILE"

CALL STARTFANUK   '* This Block of code Generates the
CNC file to run the FANUK controller
FOR I = 1 TO P STEP 2                                  '*
  CALL XthenLEFT(I)                                    '*
  CALL ROTATEthenRIGHT(I)                              '*
  CALL XthenRIGHT(I + 1)                               '*
  CALL ROTATEthenLEFT(I + 1)                           '*
NEXT I                                                 '*
CALL STOPFANUK                                         '*
PRINT "DONE"

CLOSE  3
'********** END MAIN PROGRAM ***************
```

```
'*****The information below describes the two subroutines of the
CNC code ******

'THE SUBROUTINES 0171 & 0172 ARE AS FOLLOWS

'0171;
'G91 G01 Y 0.00200 F 1.0;
'G91 G01 Y 0.01587 F 0.03;
'G91 G01 Y 0.00013 F 0.005;
'G04P245;
'G91 G01  -0.013 F 1.0;
'M99;
';

'0172;
'G91 G01 Y 0.01287 F 0.03;
'G91 G01 Y 0.00013 F 0.005;
'G04P245;
'G91 G01 Y -0.018 F 1.0;
'M99;
';

SUB ROTATEthenLEFT (A)

CABS = -1 * (LEFT(A) + 90) + TOOLANG
PRINT #3, USING "G01 G90 C ##.###### F 300.0;"; CABS
PRINT #3, "M98 P172 L1;"

END SUB

SUB ROTATEthenRIGHT,(A)

CABS = -1 * (90 - RIGHT(A))
PRINT #3, USING "G01 G90 C ##.###### F 300.0;"; CABS
PRINT #3, "M98 P172 L1;"

END SUB

SUB STARTFANUK

PRINT #3, ";"
PRINT #3, "G94 G20 G61;"

END SUB
```

```
SUB STOPFANUK

PRINT #3, "M54;"
PRINT #3, "M50;"
PRINT #3, "M58;"
PRINT #3, "M59;"
PRINT #3, "M51;"
PRINT #3, "M02;"
PRINT #3, "M00;"
PRINT #3, ";"

END SUB

SUB XthenLEFT (A)

PRINT #3, USING "G00 G91 X  ##.###### F 1.0;"; XMOVE(A)
XPOS = XPOS + XMOVE(A)
CABS = -1 * (LEFT(A) + 90) + TOOLANG
PRINT #3, USING "G01 G90 C ####.###### F 300.0;"; CABS
PRINT #3, "M98 P171 L1;"

END SUB

SUB XthenRIGHT (A)
PRINT #3, USING "G00 G91 X ##.###### F 1.0;"; XMOVE(A)
XPOS = XPOS + XMOVE(A)
CABS = -1 * (90 - RIGHT(A))
PRINT #3, USING "G01 G90 C ####.###### F 300.0;"; CABS
PRINT #3, "M98 P171 L1;"

END SUB
```

What is claimed is:

1. A nail tool for filing, polishing and/or buffing a nail, comprising a substrate having a major surface and an abrasive article fixedly attached to said major surface of said substrate by a first attachment means, said abrasive article comprising a backing having a major surface having deployed in fixed position thereon first and second three-dimensional abrasive composites, each of said composites comprising abrasive particles dispersed in a binder and having a substantially precise shape defined by a substantially distinct and discernible boundary which includes substantially specific dimensions, wherein said first abrasive composite has a first precise shape having specific first dimensions and said second abrasive composite has a second precise shape and second specific dimensions, wherein each of said abrasive composites has a base plane and a boundary defined by at least four planar surfaces wherein adjacent planar surfaces of one composite meet at an edge to define an angle of intersection therebetween, wherein at least one angle of intersection of said first abrasive composite is different from all of the angles of intersection of said second composite.

2. The nail tool of claim 1, wherein said substrate further comprises a second major surface, and an abrasive article fixedly attached to said second major surface of said substrate by a second attachment means.

3. The nail tool of claim 2, wherein said first and second attachment means comprise a double-sided pressure-sensitive adhesive foam tape.

4. The nail tool of claim 1, wherein said first attachment means comprises a water-insoluble material.

5. The nail tool of claim 1, wherein said substrate comprises a rigid discrete sheet.

6. The nail tool of claim 1, wherein said substrate comprises a discrete rigid sheet material selected from rigid polystyrene sheet or wood.

7. The nail tool of claim 1, wherein said substrate comprises a flexible compressible material having an elongate polygonal shape.

8. The nail tool of claim 1, wherein said substrate comprises a flexible compressible foam material having an elongate rectangular shape.

9. The nail tool of claim 1, wherein said nail is selected from a natural nail or an artificial polymeric nail.

10. The nail tool of claim 1, wherein at least one edge of said first composite has a length which is different from the length of all edges of the second composite.

11. The nail tool of claim 10, wherein the length of said at least one edge of said first composite has a length which varies with respect to the length of any edge of said second composite in a ratio between 10:1 to 1:10.

12. The nail tool of claim 1, wherein said first and second geometrical shapes are selected from the group of geometrical shapes consisting of cubic, prismatic, pyramidal, and truncated pyramidal.

13. The nail tool of claim 1, wherein no angle of intersection made between said base plane and an adjacent planar surface in said first abrasive composite is equal to 0° or 90°.

14. The nail tool of claim 1, wherein substantially all said abrasive composites have a pyramidal shape.

15. The nail tool of claim 1, wherein said major surface of said backing has a machine direction and opposite side edges, each side edge being parallel to the machine direction axis and each side edge being respectively within a first and second imaginary plane each of which is perpendicular to said surface, a plurality of parallel elongate abrasive ridges deployed in fixed position on said surface, each ridge having a longitudinal axis located at its transverse center and extending along an imaginary line which intersects said first and second planes at an angle which is neither 0° nor 90°, and wherein each said abrasive ridge comprises a plurality of said three-dimensional abrasive composites which are intermittently spaced along said longitudinal axis.

16. The nail tool of claim 15, wherein each abrasive ridge has a distal end spaced from said surface and each distal end extends to a third imaginary plane which is spaced from and parallel to said surface.

17. The nail tool of claim 15, wherein each said abrasive composite has a distal end which is spaced from said surface a distance of about 50 micrometers to about 1020 micrometers.

18. The nail tool of claim 1, wherein said abrasive composites are fixed on said major surface of said backing in a density of about 100 to about 10,000 abrasive composites/$cm^2$.

19. The nail tool of claim 1, wherein said major surface of said backing has a surface area, and substantially all said surface area is covered by said abrasive composites.

20. A method of abrading and polishing and/or buffing the surface of a fingernail or toenail with a nail tool, comprising the steps of:

(a) providing a nail tool comprising a substrate having major surfaces and an abrasive articles attached onto at least one surface thereof; said abrasive article having a backing having a major surface having deployed in fixed position thereon first and second three-dimensional abrasive composites, each of said composites comprising abrasive particles dispersed in a binder and having a substantially precise shape defined by a substantially distinct and discernible boundary which includes substantially specific dimensions, wherein said first abrasive composite has a first precise shape having specific first dimensions and said second abrasive composite has a second precise shape and second specific dimensions, wherein each of said abrasive composites has a base plane and a boundary defined by at least four planar surfaces wherein adjacent planar surfaces of one composite meet at an edge to define an angle of intersection therebetween, wherein at least one angle of intersection of said first abrasive composite is different from all of the angles of intersection of said second composite;

(b) bringing into frictional contact a nail surface and said abrasive article; and (c) moving at least one of said nail tool or said nail surface relative to the other such that said nail surface is abraded.

* * * * *

UNITED STATES PATENT AND TRADEMARK OFFICE

CERTIFICATE OF CORRECTION

PATENT NO. : 5,658,184
DATED : August 19, 1997
INVENTOR(S) : Hoopman, Timothy L.

It is certified that error appears in the above-identified patent and that said Letters Patent is hereby corrected as shown below:

Title page,
Item [56], References Cited, U.S. PATENT DOCUMENTS, add the following:
-- 5,527,368 06/18/1996 Supkis et al. --

Column 6,
Line 37, "an having 355" should be -- an abrasive article used in the nail tool of the invention having 355 --

Column 21,
Line 12, "mandrel 21" should be -- mandrel 121 --

Column 23,
Line 36, "this foam or" should be -- this foam material or --

Column 24,
Line 38, "about about 50" should be -- about 50 --

Column 25,
Line 39, "hoard" should be -- board --

Signed and Sealed this

Ninth Day of March, 2004

JON W. DUDAS
*Acting Director of the United States Patent and Trademark Office*